US007272959B2

(12) United States Patent
Morita et al.

(10) Patent No.: US 7,272,959 B2
(45) Date of Patent: Sep. 25, 2007

(54) REMOVABLE MOVING MEMBER FOR KNITTING AND WEFT KNITTING MACHINE PROVIDED WITH KNITTING MEMBER SWITCHING APPARATUS

(75) Inventors: Toshiaki Morita, Wakayama (JP); Takuya Miyai, Wakayama (JP); Norio Kotaka, Wakayama (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 0 days.

(21) Appl. No.: 10/574,971

(22) PCT Filed: Oct. 7, 2004

(86) PCT No.: PCT/JP2004/014860

§ 371 (c)(1),
(2), (4) Date: Apr. 7, 2006

(87) PCT Pub. No.: WO2005/035853

PCT Pub. Date: Apr. 21, 2005

(65) Prior Publication Data

US 2007/0051139 A1 Mar. 8, 2007

(30) Foreign Application Priority Data

Oct. 10, 2003 (JP) ..... 2003-352983

(51) Int. Cl.
*D04B 15/38* (2006.01)

(52) U.S. Cl. ..... 66/127

(58) Field of Classification Search ..... 66/126 A, 66/126 R, 127, 129, 128
See application file for complete search history.

(56) References Cited

U.S. PATENT DOCUMENTS

| | | | | |
|---|---|---|---|---|
| 4,354,363 | A | 10/1982 | Inoue | |
| 4,738,124 | A * | 4/1988 | Stoll et al. | 66/127 |
| 5,345,789 | A | 9/1994 | Yabuta | |
| 6,021,651 | A * | 2/2000 | Shima | 66/126 A |
| 6,647,749 | B2 * | 11/2003 | Ikoma | 66/126 A |
| 6,981,393 | B2 * | 1/2006 | Ikoma | 66/126 A |
| 6,988,385 | B2 * | 1/2006 | Miyamoto | 66/127 |
| 7,096,694 | B2 * | 8/2006 | Nakamori | 66/126 A |

FOREIGN PATENT DOCUMENTS

| | | |
|---|---|---|
| JP | 47-20452 | 9/1972 |
| JP | 63-23301 | 5/1988 |
| JP | 6-65781 | 8/1994 |
| JP | 9-268455 | 10/1997 |
| WO | 02/081800 | 10/2002 |

OTHER PUBLICATIONS

International Search Report (PCT/ISA/210).
International Preliminary Exam Report (PCT/IPEA/409).

* cited by examiner

*Primary Examiner*—Danny Worrell
(74) *Attorney, Agent, or Firm*—Harness, Dickey & Pierce, P.L.C.

(57) ABSTRACT

In order to switching yarns used for knitting by switching a plurality of yarn feeders, a knitting member switching apparatus is provided. The knitting member switching apparatus includes a plurality of holders provided on a side of a carriage, a stopping device provided on an end portion such as a left side end on a needle bed. The stopping device includes a plurality of stopping stands and switching mechanisms in correspondence with the holders, and is further provided with a control device for letting the carriages travel and for selecting knitting needles based on knitting data.

14 Claims, 36 Drawing Sheets

6, 7

14, 15

14, 15

REMOVABLE MOVING MEMBER FOR KNITTING AND WEFT KNITTING MACHINE PROVIDED WITH KNITTING MEMBER SWITCHING APPARATUS

TECHNICAL FIELD

The present invention relates to a removable moving member for knitting and a weft knitting machine provided with a knitting member switching apparatus in which a knitting member such as a yarn feeding port performing an operation of supporting to knit a fabric in the weft knitting machine is used in a removable state.

BACKGROUND ART

Conventionally, while a fabric is knitted, a yarn feeding port as a knitting member has been used in order to feed a knitting yarn at an appropriate timing to a knitting needle that performs a knitting operation. In order to knit fabric products, it is necessary to use, in a switching manner, a plurality of knitting yarns of various colors and functions. In weft knitting machines of a V-shaped bed-type in which at least a pair of needle beds of the front and the rear is provided and in which the front and rear needle beds are opposed to each other with a needle bed gap interposed therebetween, a general configuration is such that a plurality of yarn guide rails are installed above the needle bed gap, yarn feeders provided with yarn feeding ports are led to travel along the yarn guide rails, and knitting yarns are switched by switching the yarn feeders. The yarn feeders are selected by a bringing and switching apparatus provided at a bridge that couples between carriages provided respectively on the front and rear needle beds such that the yarn feeders are used while being brought by the carriages (see Japanese Examined Patent Publication JP-B2 63-23301 (1988) and Japanese Examined Patent Publication JP-B2 06-65781 (1994), for example).

A method is also known by which knitting yarns are switched by directly mounting and dismounting yarn guide tubes serving as the yarn feeding ports on/from carriages instead of using yarn feeders or other components traveling on yarn guide rails. Examples thereof include a color changing apparatus for a plain knitting machine in which a magazine that carries a plurality of yarn guide tubes referred to as yarn guide small nuts is disposed at one end of a needle bed, and when the carriage is positioned at the magazine, a yarn guide small nut mounted on the carriage is handed over to an empty carrying member, and one of carrying members that carry the yarn guide small nuts is mechanically switched from a still mode to a handing-over mode, so that the yarn guide small nut is received by the carriage (see Japanese Unexamined Patent Publication JP-A 47-20452 (1972), for example). Furthermore, the applicant of the invention also has proposed a weft knitting machine provided with a yarn guide tube changing apparatus for transferring yarn guide tubes by using a magnetic force (see Japanese Unexamined Patent Publication JP-A 09-268455 (1997), for example).

Products whose fabric is to be knitted with a weft knitting machine include products, such as gloves and socks, with a comparatively small stitch width. In order to efficiently produce these products with a small stitch width, it is required that carriages travel with a small width, at a high speed, and at a high frequency of traveling back and forth. Especially in a case where gloves are knitted, it is necessary that tubular plain stitch for each of five fingers and tubular plain stitch for an entire palm are repeated with a small width. In the methods for bringing the yarn feeding ports using the yarn guide rails as in JP-B2 63-23301 and JP-B2 06-65781, the bringing and switching apparatus such as a bringing pin is provided on the side of the carriages, and thus the carriages become bulky and heavy, so that the durability is impaired in a weft knitting machine in which travels are heavily repeated with a small width and at a high speed. Furthermore, when the frequency at which the carriages travel back and forth becomes high, there is a possibility that the yarn guide rails vibrate or are warped, and thus the yarn feeding becomes unstable. In addition, the yarn guide rails occupy the space above the narrow needle bed gap, and thus an operation of letting yarns pass through yarn feeders mounted on the yarn guide rails and a maintenance operation become difficult.

In the color changing apparatus as shown in JP-A 47-20452, the yarn guide small nuts are unstable because they are gripped between flexible members, and thus the yarn guide small nuts may be likely to vibrate when modes are switched from a still mode to a handing-over mode. Furthermore, a space in which the yarn guide small nuts are gripped is necessary, and thus an operation of letting yarns pass through the yarn guide small nuts, for example, may be complicated. In the yarn guide tube changing apparatus as in JP-A 09-268455, the length in which magnets are provided on the front and rear faces of the yarn guide tubes is necessary, and thus an operation of letting yarns pass through the yarn guide tubes is complicated. Since the yarn guide tubes are kept with a magnetic force, there is a possibility that the position of the yarn guide tubes is shifted due to vibrations or impacts.

DISCLOSURE OF INVENTION

It is an object of the invention to provide a removable moving member for knitting and a weft knitting machine provided with a knitting member switching apparatus in which with a simple structure, it is possible to easily change knitting members such as yarn feeding ports and the mounted knitting members can be firmly held without being bulky.

The invention is directed to a removable moving member for knitting having a base end portion and a front end portion, in which the base end portion can be mounted on and dismounted from travel means that travels along a needle bed of a weft knitting machine, which is moved by being carried by the travel means without using a rail for traveling only when the moving member is mounted on the travel means, and in which an operation of supporting to knit a fabric can be performed at the front end portion when the base end portion is mounted on the travel means, comprising:

hook means that is provided on the base end portion, and that can be switched between a hook state in which the hook means is mounted on the travel means while hooking a support member provided in the hook means by sandwiching the support member in a vertical direction and a non-hook state in which the hook means is not hooked on the travel means, and biasing means that is provided on the base end portion, and that biases with a spring such that a hook state of the hook means on the travel means is kept when mounted on the travel means to hold the removable moving member by the travel means, wherein the hook means can be switched from the hook state to the non-hook state against a biasing force of the biasing means when a predetermined external force is applied.

Furthermore, the invention is characterized in that:

the hook means includes a pair of levers that intersect each other in a middle in a shape of an X, that can be swingingly displaced around an intersecting portion, that have one end sides for hooking on the travel means, and that have other end sides for receiving the predetermined external force, and the biasing means biases with a spring the pair of levers such that the one end sides move closer to each other.

Furthermore, the invention is characterized in that:

the biasing means has a wire-shaped or plate-shaped spring that is provided at a position closer to the one end sides of the levers with respect to the intersecting portion of the pair of levers of the hook means, and that has a middle portion curved using the intersecting portion as a supporting point such that both ends can move resiliently, and the levers have pressing portions that are provided on portions on the other end sides with respect to the intersecting portion, that abut against the spring, and that receive the biasing force of the spring with a pressing force from the spring.

Furthermore, the invention is directed to a weft knitting machine provided with a knitting member switching apparatus, comprising:

travel means that is provided with a holder provided with a support member on which the removable moving member for knitting described in any one of the above descriptions can be mounted, stopping means that is provided on a path on which the travel means travels, and that stops the removable moving member for knitting, switching means that is provided on the stopping means, and that can apply an external force for switching the hook means of the removable moving member for knitting between the hook state and the non-hook state, and a knitting member switching apparatus for shifting to a state in which the removable moving member for knitting is stopped by the stopping means, by switching the base end portion to the non-hook state with respect to the holder, by applying an external force from the switching means to the hook means, when the travel means passes by the stopping means while the removable moving member for knitting is mounted as the knitting member on the holder, and for switching between keeping a state in which the removable moving member for knitting is stopped by the stopping means and shifting to the hook state in which the removable moving member for knitting is mounted on the holder of the travel means, by applying or not applying an external force from the switching means to the hook means, when the travel means passes by the stopping means while the removable moving member for knitting is stopped by the stopping means.

Furthermore, the invention is characterized in that:

the holder has a plurality of positions on which the removable moving member for knitting can be mounted, and the knitting member switching apparatus mounts the removable moving member for knitting on the holder by selecting one from the plurality of positions.

Furthermore, the invention is characterized in that the switching means includes:

a stopping control lever that projects from the stopping means to one side of a path on which the travel means travels such that the stopping control lever is along the path, that can be swingingly displaced around a supporting point provided on the other side on the path, and that can slidingly abut against the other sides on the hook means when the travel means on which the removable moving member for knitting is mounted moves closer from the one side, a biasing member for biasing the stopping control lever to a direction in which an external force for switching the hook means to the non-hook state is not applied, a force receiving member that is provided at a position, away over the supporting point, on the other side on the path, and that swingingly displaces the stopping control lever in a direction in which the one side applies an external force for switching the hook means to the non-hook state, against a biasing force of the biasing member, when a pressing force is received while the holder that is provided on the travel means passes by, and lever lock means that can lock a state in which the stopping control lever is swingingly displaced with a pressing force to the force receiving member, and that the stopping means has a stopper portion that is provided on the other side on the path, and that allows the travel means to travel while preventing the removable moving member for knitting from moving.

Furthermore, the invention is characterized in that the switching means includes:

a stopping control lever that projects from the stopping means to one side of a path on which the travel means travels such that the stopping control lever is along the path, that can be swingingly displaced around a supporting point provided on the other side on the path, and that can slidingly abut against the other sides on the hook means when the travel means on which the removable moving member for knitting is mounted moves closer from the one side, and an actuator for switching the stopping control lever between a state in which an external force for switching the hook means to the non-hook state is not applied and a state in which the external force is applied, and that the stopping means has a stopper portion that is provided on the other side on the path, and that allows the travel means to travel while preventing the removable moving member for knitting from moving.

Furthermore, the invention is characterized in that the stopping means includes:

stopping stopper means for preventing the removable moving member for knitting from moving such that the removable moving member for knitting does not move together with the holder when the travel means lets the holder advance from the other side while the removable moving member for knitting is stopped, and for canceling the prevention when the holder passes by, and a sensor for detecting whether or not there is the removable moving member for knitting at the position of the stopper portion.

Furthermore, the invention is characterized in that a plurality of removable moving members for knitting, a plurality of holders, and a plurality of stopping means are provided, and the knitting member switching apparatus selectively mounts one or a plurality of removable moving members for knitting on the holders that are provided in correspondence with the selected removable moving members for knitting.

Furthermore, the invention is characterized in that the removable moving member for knitting has a function as the knitting member, as a yarn feeding port for feeding a knitting yarn to a knitting needle.

Furthermore, the invention is characterized in that the travel means is a carriage that travels back and forth along a needle bed and that lets knitting needles arranged side by side on the needle bed perform a knitting operation.

Furthermore, the invention is characterized in that the travel means travels on a path that is provided so as to face a side on which a fabric is knitted on the needle bed.

Furthermore, the invention is characterized in that the stopping means, the switching means, and the knitting member switching apparatus can move.

BRIEF DESCRIPTION OF DRAWINGS

Other and further objects, features, and advantages of the invention will be more explicit from the following detailed description taken with reference to the drawings wherein.

BEST MODE FOR CARRYING OUT THE INVENTION

Figure 1:
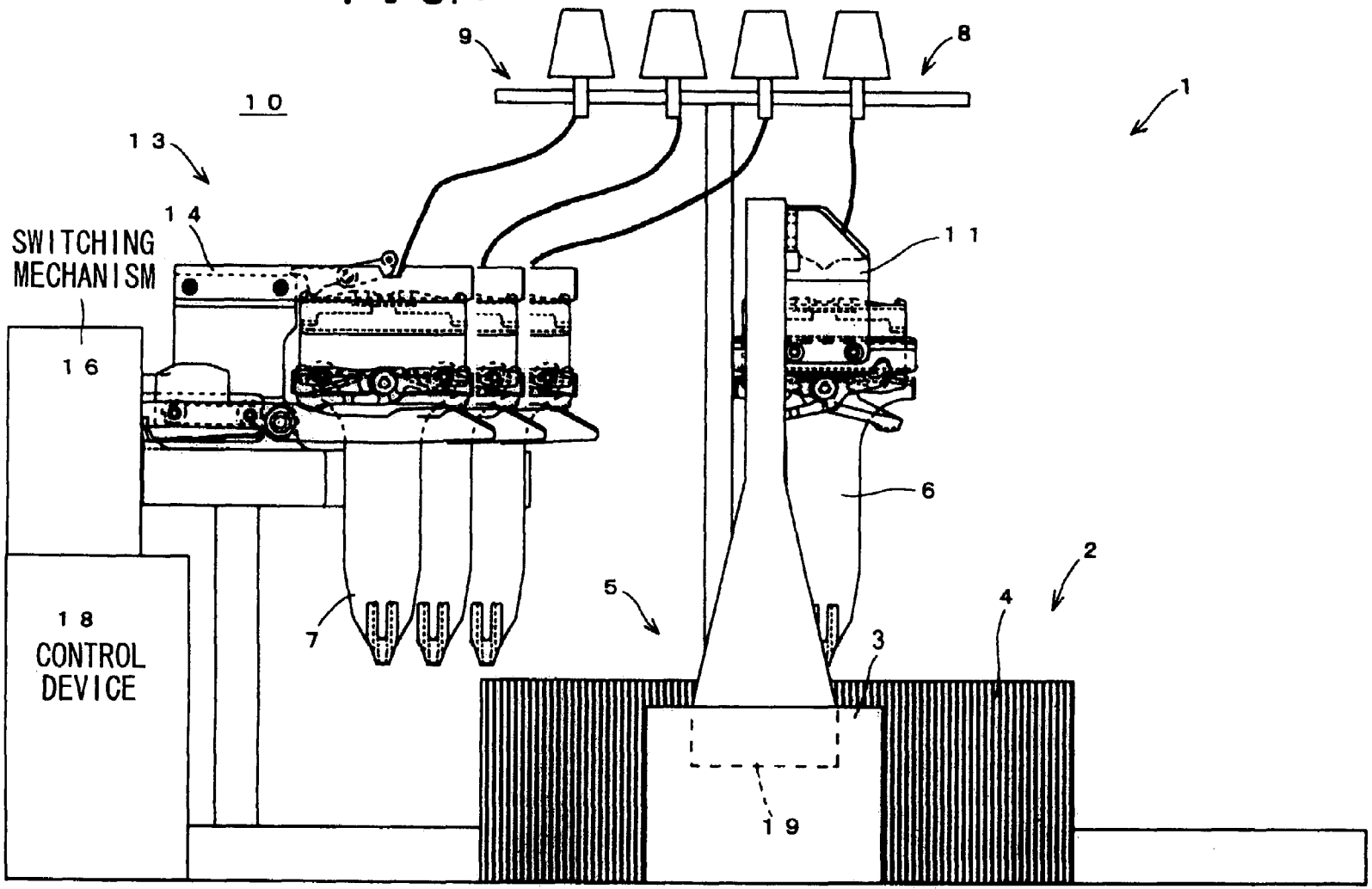
FIG. 1 is a simplified front view of a weft knitting machine 1, which is an embodiment of the invention.

Now referring to the drawings, preferred embodiments of the invention are described below.

Figure 2:
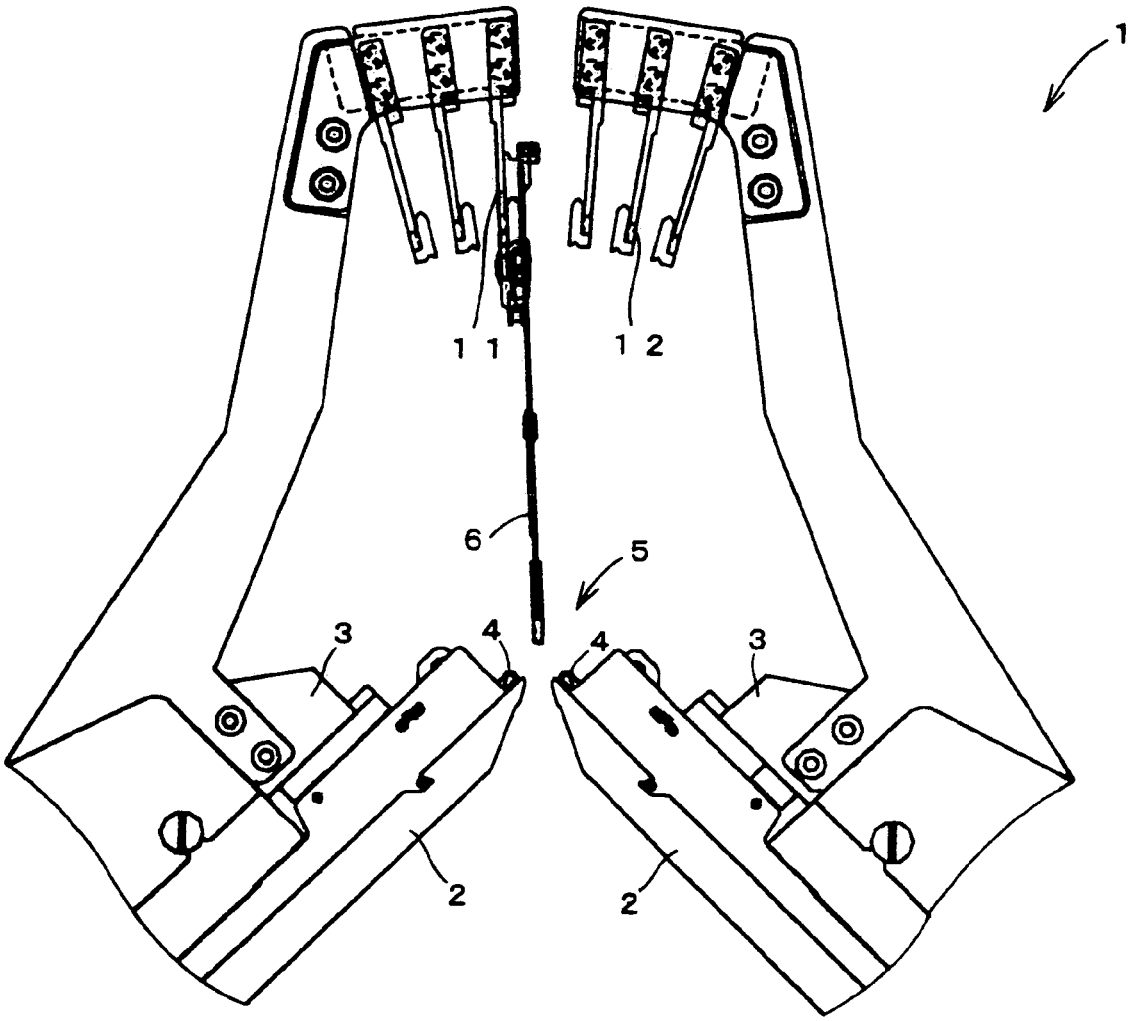
FIG. 2 is a right side view of the weft knitting machine 1 in FIG. 1.
Figure 3:
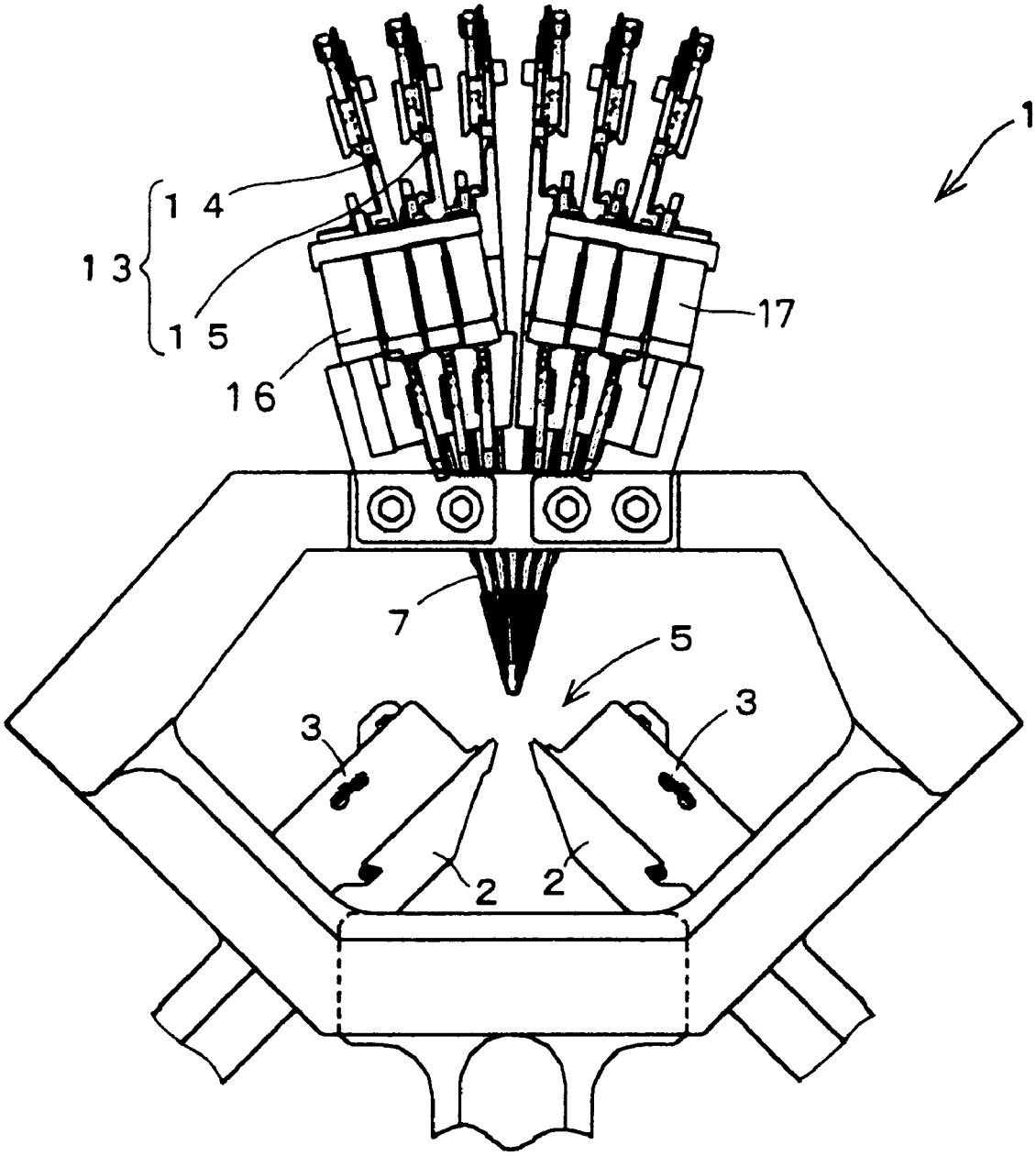
FIG. 3 is a left side view of the weft knitting machine 1 in FIG. 1.

FIGS. 1, 2, and 3 show a schematic configuration of a Weft knitting machine 1, which is an embodiment of the invention. FIG. 1 shows a front view, FIG. 2 shows a right side view (right side view when bringing a knitting member) of FIG. 1, and FIG. 3 shows a left side view (left side view of a knitting member switching apparatus) of FIG. 1. In the weft knitting machine 1, a fabric is knitted while carriages 3 are led to travel back and forth along needle beds 2. On the needle beds 2, a large number of knitting needles 4 are arranged side by side, and selectively perform an operation of moving forward into and backward from a needle bed gap 5 by receiving an action of knitting cams that are mounted on the carriages 3. The weft knitting machine 1 is a weft knitting machine of a V-shaped bed-type in which the pair of needle beds 2 of the front and the rear are opposed to each other with the needle bed gap 5 interposed therebetween, and a fabric can be knitted by selectively bringing a plurality of yarn feeders 6 and 7 to the carriages 3, by feeding knitting yarns to the knitting needles, and thus by repeatedly forming knitting loops. It is possible to feed knitting yarns respectively from yarn feeding apparatuses 8 and 9 to the yarn feeders 6 and 7.

The weft knitting machine 1 is provided with a knitting member switching apparatus 10 in order to switch knitting yarns that are used for knitting, by switching the plurality of yarn feeders 6 and 7. The knitting member switching apparatus 10 includes a plurality of holders 11 and 12 provided on the side of the carriages 3 and a stopping device 13 provided on the end portion such as the left side end on the needle beds 2. The stopping device 13 includes a plurality of stopping stands 14 and 15 and switching mechanisms 16 and 17 in correspondence with the holders 11 and 12, and is further provided with a control device 18 for letting the carriages 3 travel and for selecting the knitting needles 4 based on knitting data. Furthermore, a yarn feeding position switching apparatus 19 is also provided in which the position at which the yarn feeders 6 and 7 feed a yarn is switched between a right travel and a left travel of the carriages 3.

Figure 4:
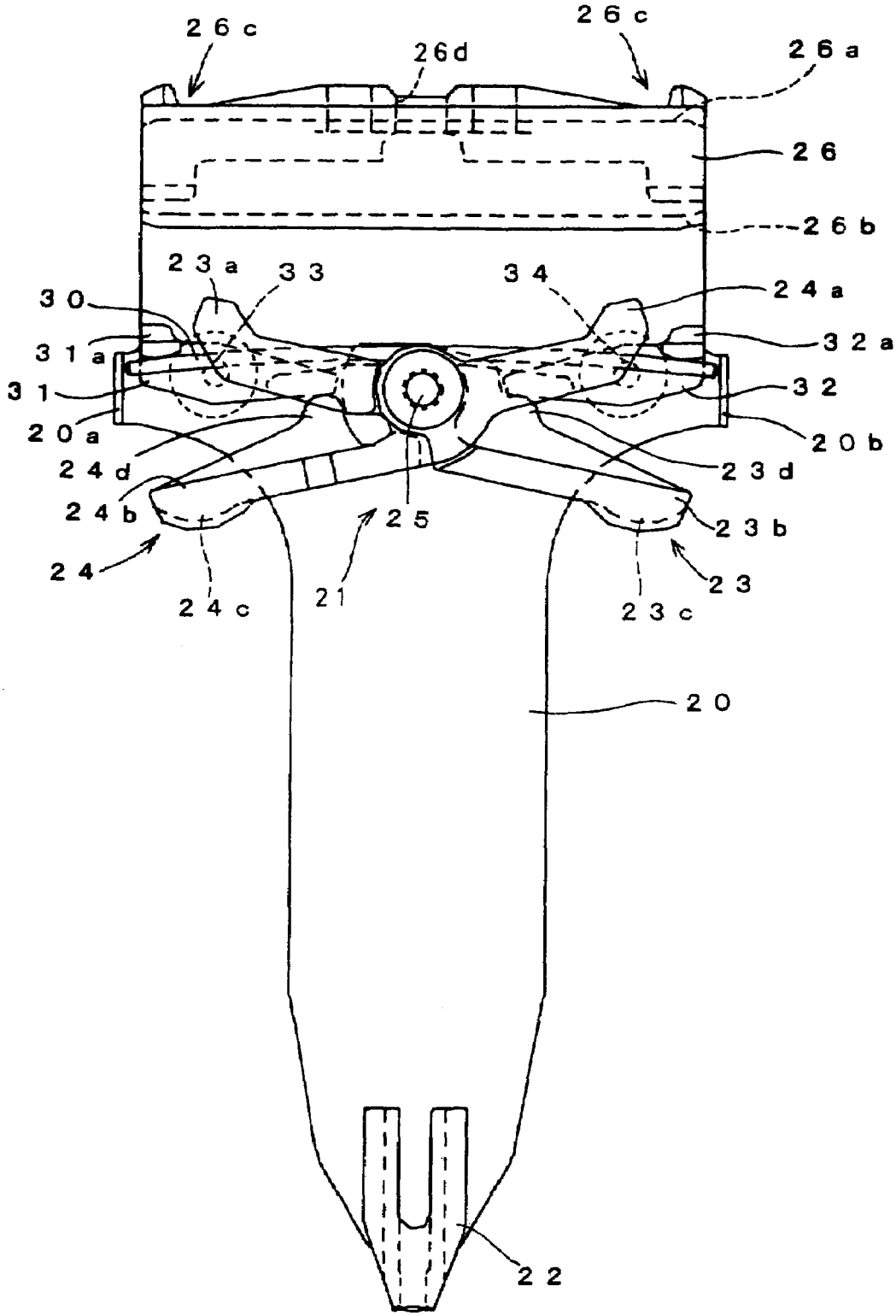
FIG. 4 is a front view of a yarn feeder 6, 7 in FIG. 1.
Figure 5:
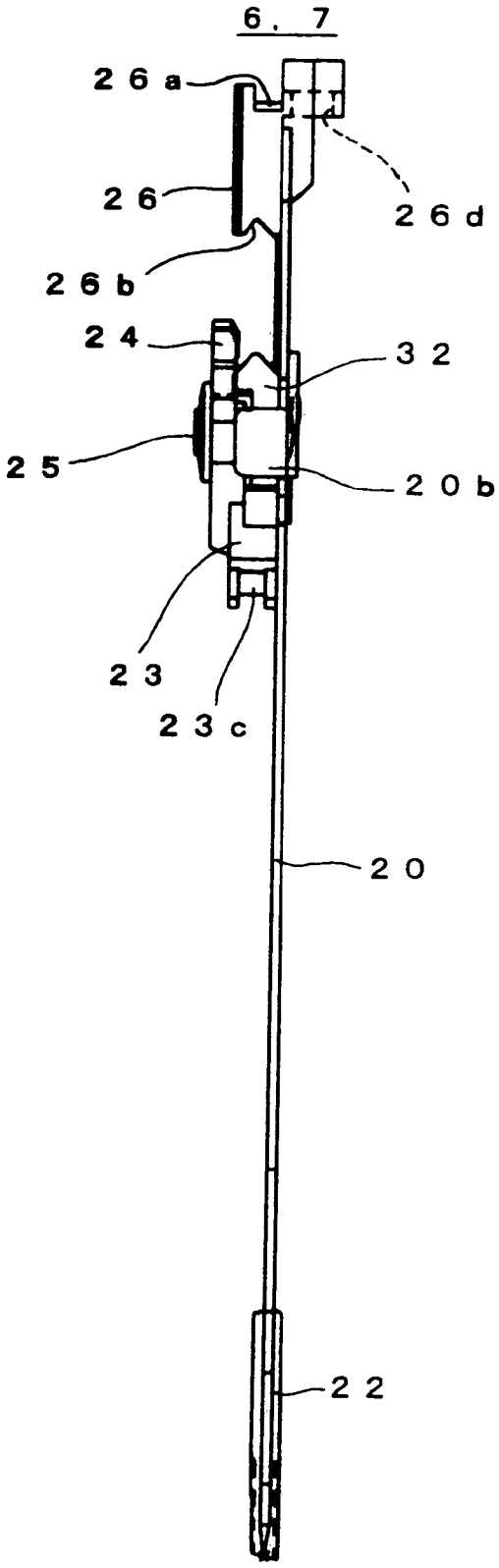
FIG. 5 is a right side view of the yarn feeder 6, 7 in FIG. 4.
Figure 6:
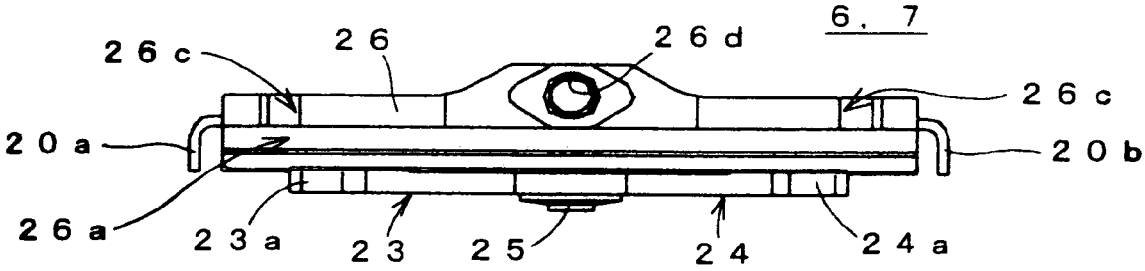
FIG. 6 is a plan view of the yarn feeder 6, 7 in FIG. 4.

FIGS. 4, 5, and 6 show the configuration of the yarn feeder 6, 7 shown in FIGS. 1 to 3. FIG. 4 shows a front view, FIG. 5 shows a right side view, and FIG. 6 shows a plan view. The yarn feeder 6, 7 is provided with a hook mechanism 21 on the base end side of a base 20 in the shape of a rod, and a yarn feeding port 22 on the front end side. The hook mechanism 21 is provided with a pair of levers 23 and 24 and a swinging shaft 25. A guide member 26 is fixed at the end of the base end portion of the base 20. The upper and lower portions of the guide member 26 are respectively provided with grooves 26*a* and 26*b*. The upper portion is provided also with recesses 26*c* that are to be locked with the stopping stand 14, 15. Furthermore, the rear upper portion is provided with a yarn insertion hole 26*d* through which a knitting yarn passes.

The pair of levers 23 and 24 of the hook mechanism 21 intersect each other in the middle in the shape of an X, and can be swingingly displaced around the swinging shaft 25 that is inserted into the intersecting portion. One end sides 23*a* and 24*a* of the levers 23 and 24 have protrusions that can be hooked on the holder 11, 12. An external force can act on other end sides 23*b* and 24*b* of the levers 23 and 24. In a state where an external force does not act on the other end sides 23*b* and 24*b*, the levers 23 and 24 have the same phase, that is, the levers 23 and 24 are bilaterally-symmetric. Grooves 23*c* and 24*c* are formed respectively on the portions for receiving an external force, on the other end sides 23*b* and 24*b*. It is possible to switch a hook state and a non-hook state with respect to the holder 11, 12, by opening and closing the one end sides 23*a* and 24*a*, with application of an external force between the other end sides 23*b* and 24*b* of the pair of levers 23 and 24.

A wire spring 30 is also disposed adjacent to the hook member 21. The wire spring 30 is made of an elastic material such as a piano wire, both ends thereof are guided by protrusions 31*a* and 32*a* of a pair of swinging pieces 31 and 32 that are provided on both sides in a width direction of the base 20, and bending portions 20*a* and 20*b* of the base 20, and the middle portion is curved using the intersecting portion of the levers 23 and 24 as a supporting point such that both ends can move resiliently. It is also possible to use a plate-shaped spring instead of a wire-shaped spring such as the wire spring 30. Swinging supporting points 33 and 34 are provided respectively in the middle portions of the swinging pieces 31 and 32. The levers 23 and 24 of the hook mechanism 21 are respectively provided with pressing portions 23*d* and 24*d* for receiving a pressing force from the wire spring 30 between the swinging supporting points 33 and 34 and the other end sides 23*b* and 24*b*. When an external force acts on the other end sides 23*b* and 24*b* of the levers 23 and 24, the levers 23 and 24 swing, the pressing portions 23*d* and 24*d* of the levers 23 and 24 press the swinging pieces 31 and 32, the swinging pieces 31 and 32 swing using the swinging supporting points 33 and 34 as axes, and thus the wire spring 30 is curved. The wire spring 30, which is biasing means, biases between the other end sides 23*b* and 24*b* of the levers 23 and 24 of the hook mechanism 21, which is hook means, such that the one end sides 23*a* and 24*a* of the levers 23 and 24 move closer to each other. Thus, when the one end sides 23*a* and 24*a* of the levers 23 and 24 are hooked on the holder 11, 12 in a direction in which the one end sides 23*a* and 24*a* are closed, it is possible to keep a hook state with a biasing force of the spring.

Figure 7:
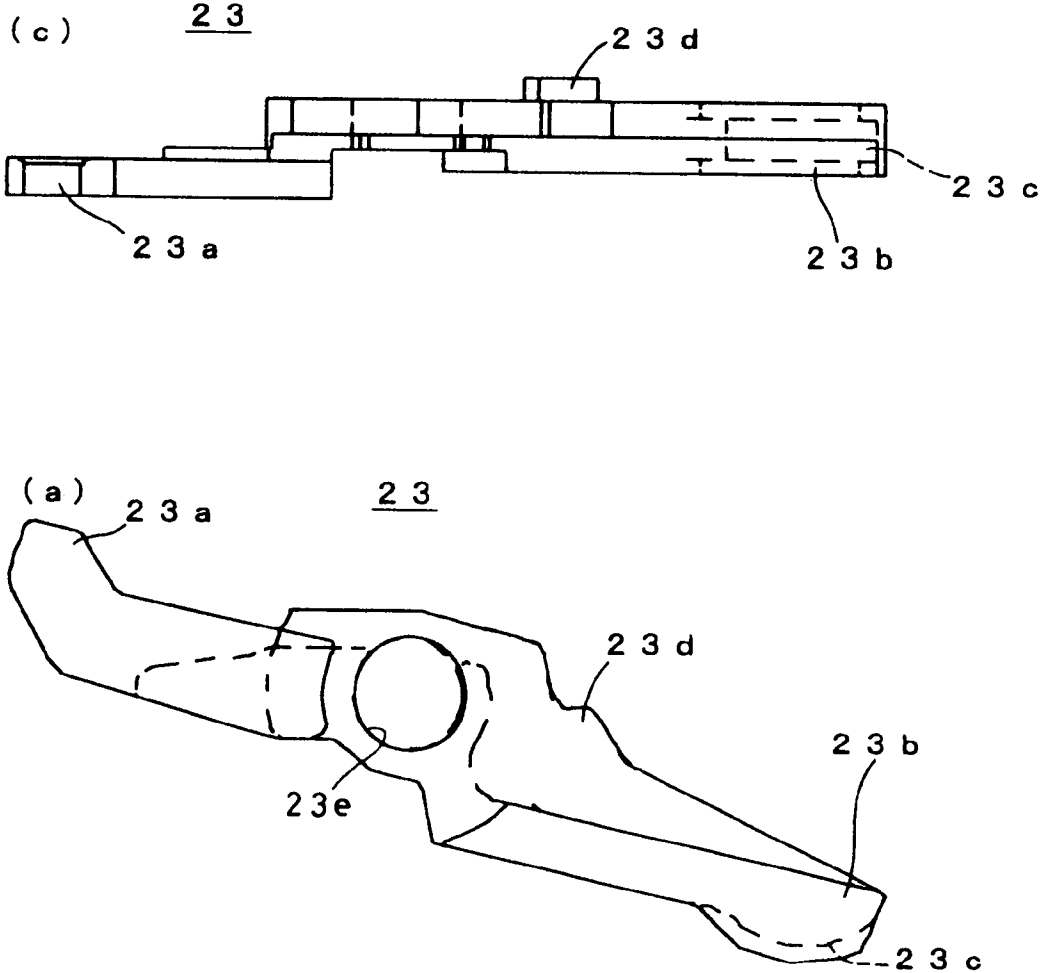
FIG. 7 shows a front view, a right side view, and a plan view of a lever 23 shown in FIGS. 4 to 6.
Figure 8:
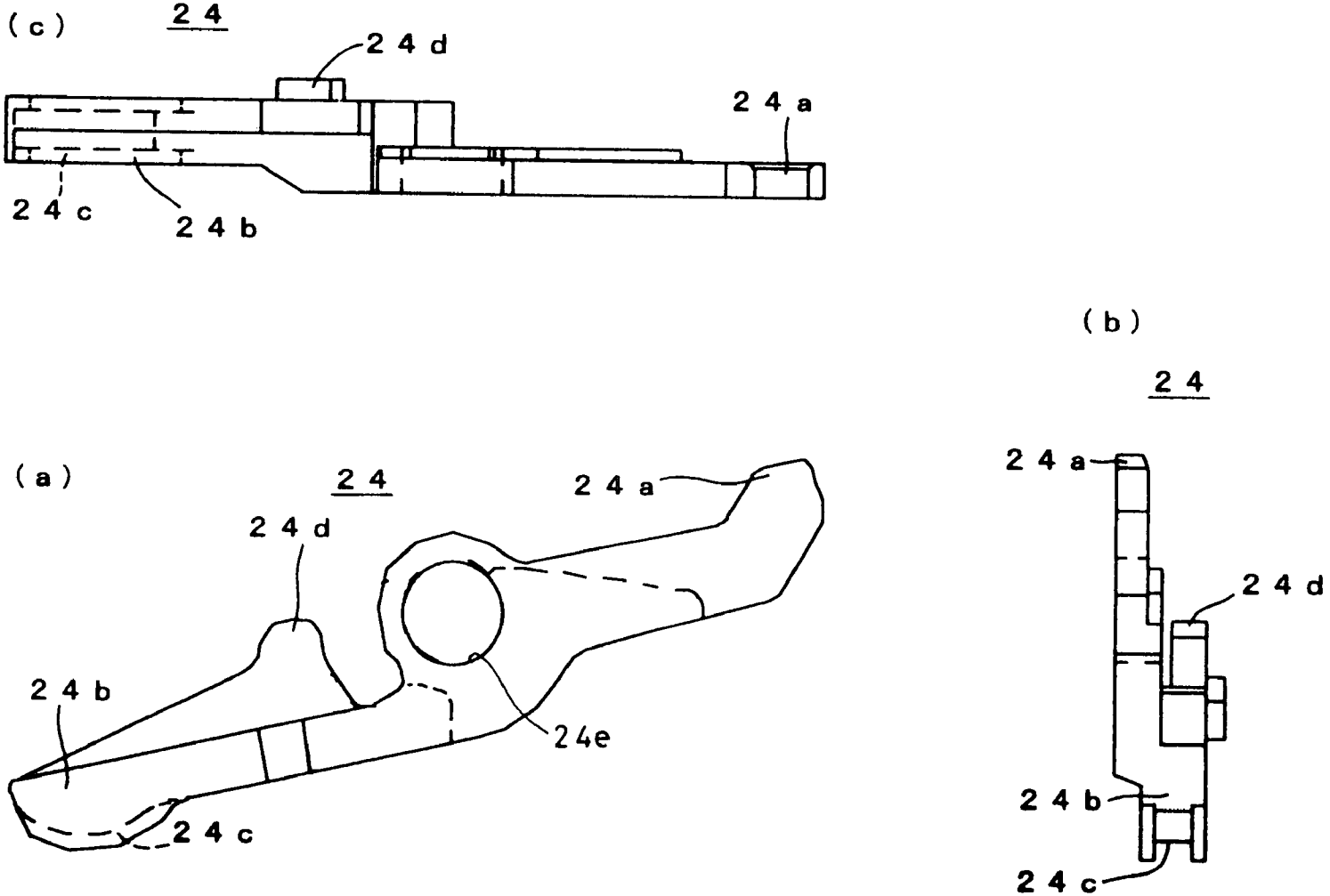
FIG. 8 shows a front view, a right side view, and a plan view of a lever 24 shown in FIGS. 4 to 6.
Figure 9:
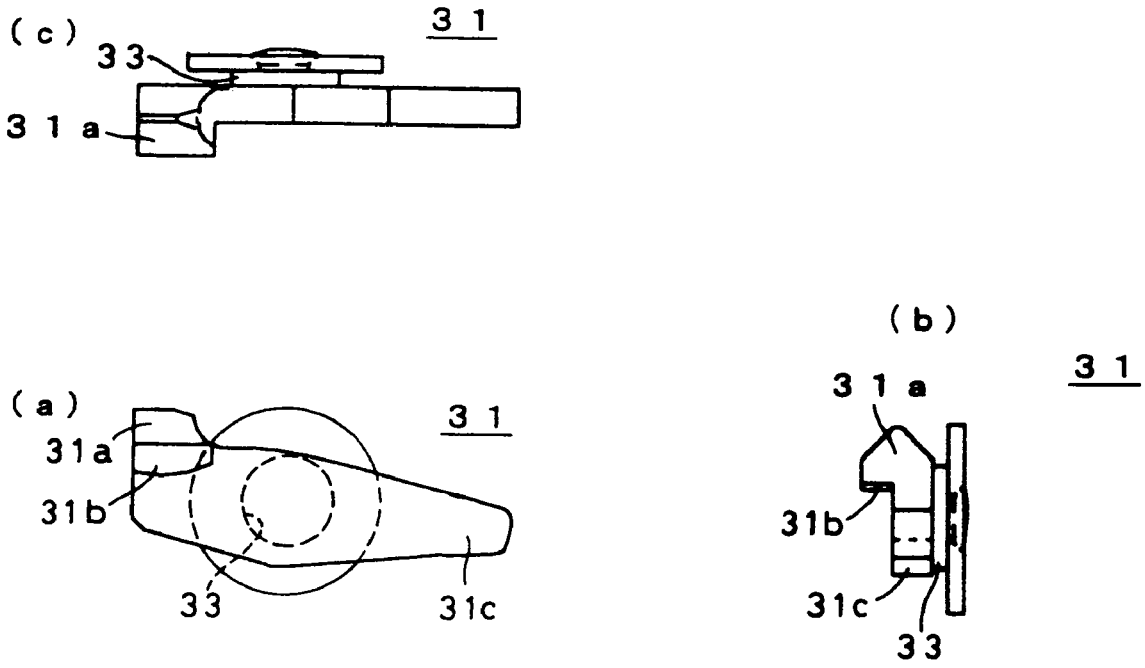
FIG. 9 shows a front view, a right side view, and a plan view of a swinging piece 31 shown in FIGS. 4 to 6.

FIGS. 7 and 8 respectively show the shapes of the levers 23 and 24 shown in FIGS. 4 to 6. FIG. 9 shows the shape of the swinging piece 31 shown in FIGS. 4 to 6. The other swinging piece 32 is shaped such that the swinging pieces 31 and 32 are bilaterally-symmetric. FIGS. 7(*a*), 8(*a*), and 9(*a*) show front views, FIGS. 7(*b*), 8(*b*), and 9(*b*) show right side views, and FIGS. 7(*c*), 8(*c*), and 9(*c*) show plan views.

Insertion holes 23*e* and 24*e* into which the swinging shaft 25 shown in FIG. 4 is inserted are formed respectively in the middle portions of the levers 23 and 24. The levers 23 and 24 are combined so as to intersect each other in the shape of an X in a state where the swinging shaft 25 is inserted into the insertion holes 23*e* and 24*e*, and a portion of the insertion holes 23*e* and 24*e* serves as the intersecting portion. The one end sides 23*a* and 24*a*, which are on the upper side on the levers 23 and 24, are fitted from the below to recesses provided in correspondence with the holder 11, 12. The other end sides 23*b* and 24*b*, which are on the lower side on the levers 23 and 24, receive an external force from the below at the stopping stand 14, 15. The pressing portions 23*d* and 24*d* projecting upward are formed respectively on the same sides as the other end sides 23*b* and 24*b*, with respect to the insertion holes 23*e* and 24*e*, on the levers 23 and 24.

The swinging piece 31 can be swingingly displaced around the swinging supporting point 33 in the middle. The protrusion 31*a* projects upward on one end side with respect to the swinging supporting point 33. The protrusion 31*a* is shaped so as to be fitted to a groove 45*d* that is formed on the bottom face of a support member 45 of the holder 11, 12, which will be described later. A lower end portion 31*b* of the protrusion 31*a* presses the vicinity of the front end of the wire spring 30 from the above. A lower end portion 31*c* on the other side, with respect to the swinging supporting point 33, on the swinging piece 31 abuts against the pressing portion 23*d* of the lever 23. Also on the other swinging piece 32, the lower end portion of the protrusion 32*a* presses the wire spring 30, and the lower end portion on the other end side abuts against the pressing portion 24*d* of the lever 24.

The wire spring 30 is about to return to a linear state in which the wire spring 30 is not curved, so that the wire spring 30 presses up the lower end portions of the protrusions 31*a* and 32*a* of the swinging pieces 31 and 32. This pressing-up force acts as a pressing-down force on the pressing portions 23*d* and 24*d* of the levers 23 and 24, and thus the biasing force is applied to a direction in which the one end sides 23*a* and 24*a* of the levers 23 and 24 are closed.

Figure 10:
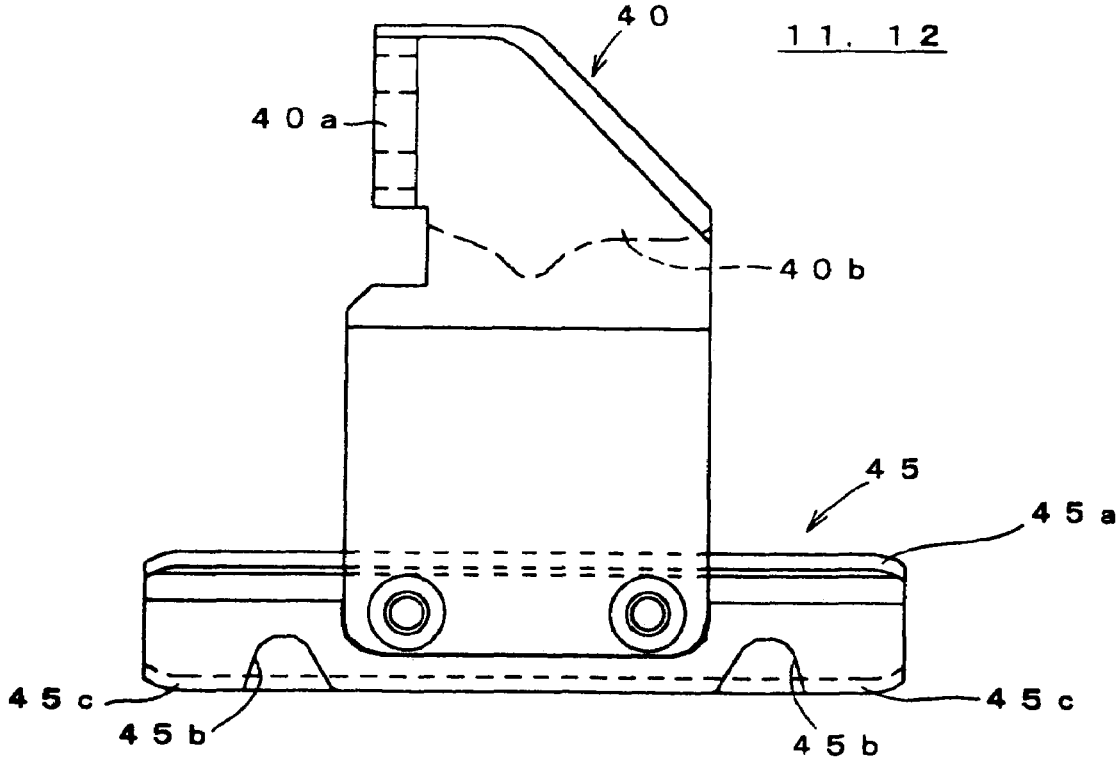
FIG. 10 is a front view of a holder 11, 12 in FIG. 1.
Figure 11:
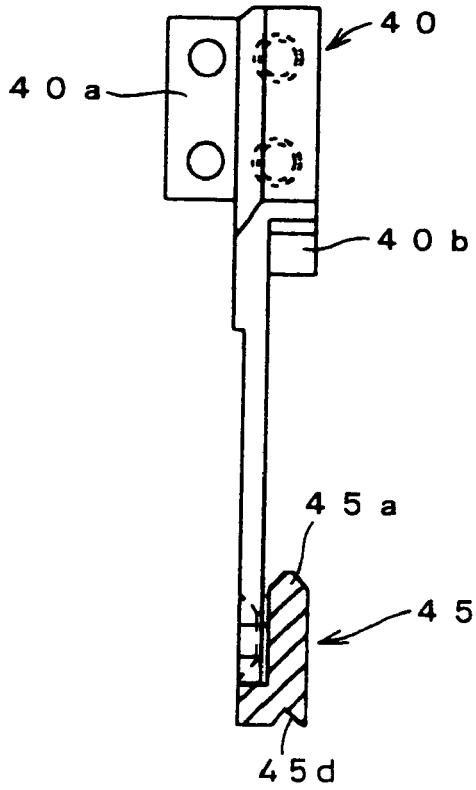
FIG. 11 is a right side view of the holder 11, 12 in FIG. 10.
Figure 12:
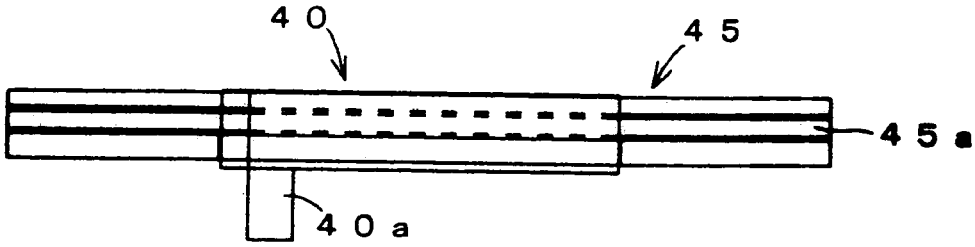
FIG. 12 is a plan view of the holder 11, 12 in FIG. 10.

FIGS. 10, 11, and 12 show the configuration of the holder 11, 12 shown in FIGS. 1 to 3. FIG. 10 shows a front view, FIG. 11 shows a right side view, and FIG. 12 shows a plan view. The holder 11, 12 includes an attachment member 40 and the support member 45. The attachment member 40 has an attachment portion 40*a* that is to be attached to the carriage 3, and a cam groove 40*b* for unlocking the yarn feeder 6, 7 from the recess 26*c* of the guide member 26. The support member 45 has a ridge 45*a* that is fitted to the groove 26*b* on the lower side on the guide member 26, recesses 45*b* on which the one end sides 23*a* and 24*a* of the levers 23 and 24 of the yarn feeder 6, 7 are hooked, and pressing portions 45*c* for actuating the switching mechanism 16, 17 provided on the stopping stand 14, 15. The groove 45*d* to which the protrusions 31*a* and 32*a* of the swinging pieces 31 and 32 are fitted is also formed on the bottom face of the support member 45.

Figure 13:
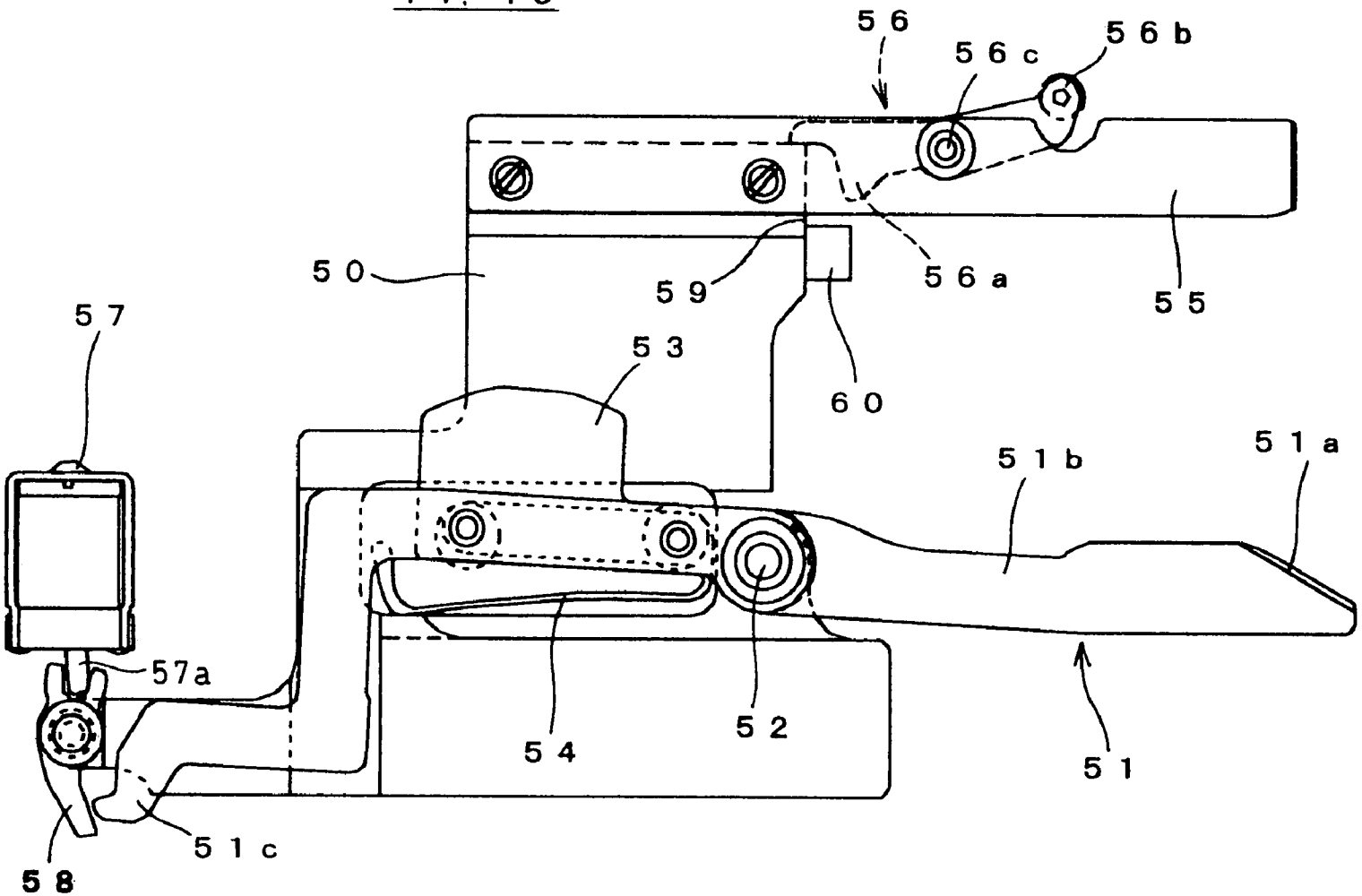
FIG. 13 is a front view showing a state in which an external force for switching a hook mechanism 21 of the yarn feeder 6, 7 to a non-hook state does not act in stopping stand 14, 15 in FIG. 1.
Figure 14:
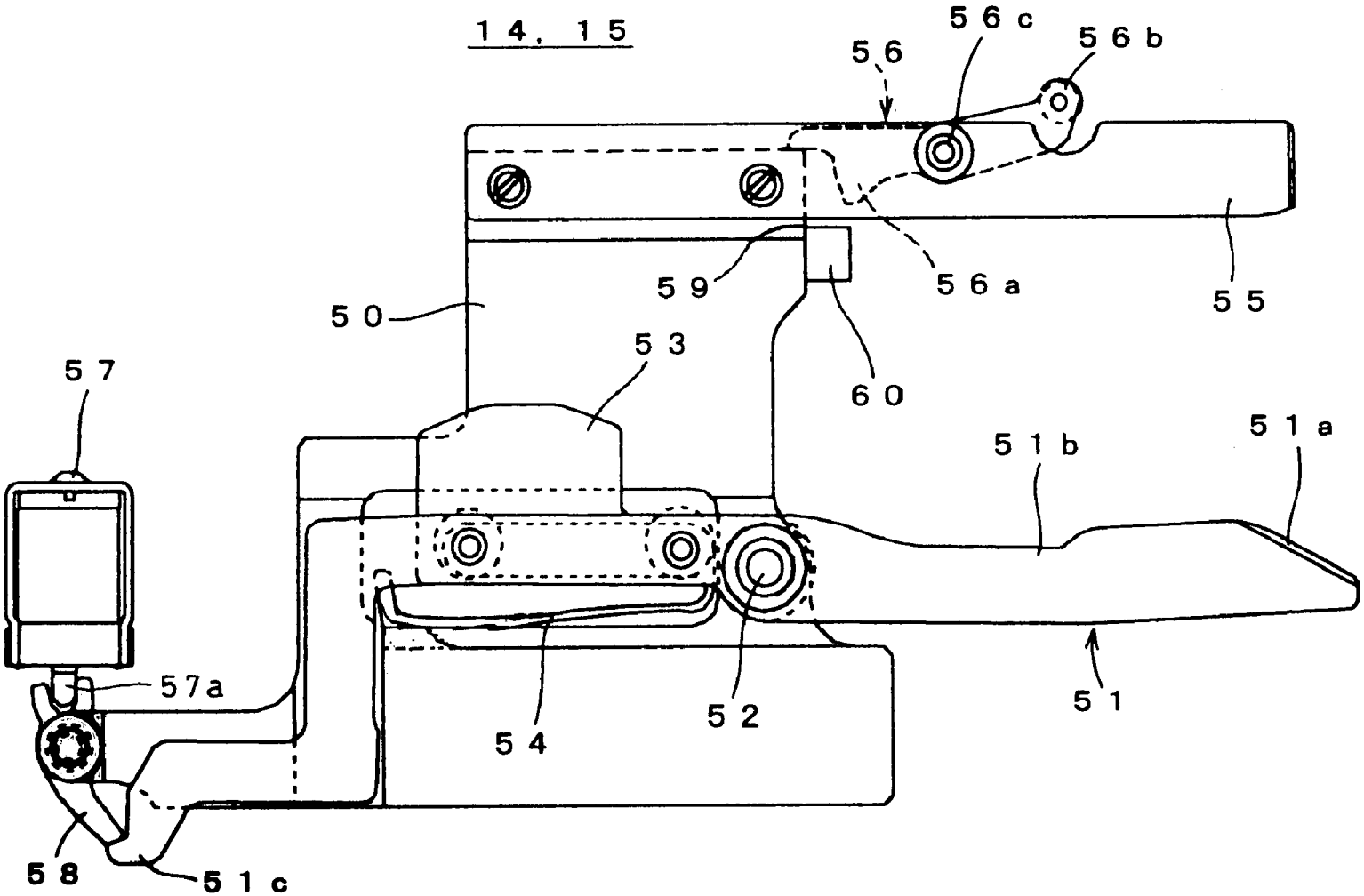
FIG. 14 is a front view showing a state in which an external force for switching the hook mechanism 21 of the yarn feeder 6, 7 to a non-hook state acts in the stopping stand 14, 15 in FIG. 1.

FIGS. 13 and 14 show the configuration of the stopping stand 14, 15 shown in FIGS. 1 and 3 as a mechanism viewed from the front. FIG. 13 shows a state in which an external force for switching the hook mechanism 21 of the yarn feeder 6, 7 to a non-hook state does not act, and FIG. 14 shows a state in which lock is performed such that an external force for switching the hook mechanism 21 to a non-hook state acts. In the stopping stand 14, 15, a stopping control lever 51 projects from the lower portion of a frame 50 that is provided upright from the needle bed 2 in FIGS. 1 and 3, along the path at which the carriage 3 arrives. The stopping control lever 51 can slidingly abut from the below against the other end sides 23*b* and 24*b* of the levers 23 and 24 of the hook mechanism 21 of the yarn feeder 6, 7 that is hooked on the holder 11, 12 attached to the carriage 3. An inclination portion 51*a* is provided on one side of the stopping control lever 51, and the upper end of the inclination portion 51*a* is fitted to the grooves 23*c* and 24*c* of the other end sides 23*b* and 24*b* of the levers 23 and 24.

The stopping control lever 51 can be swingingly displaced around a swinging shaft 52 that is provided in the middle. A recess 51*b* is provided between the inclination portion 51*a* and the swinging shaft 52. On the stopping control lever 51, a lock portion 51*c* is provided on the other side that is different from the one side having the inclination portion 51*a*, with the swinging shaft 52 interposed therebetween. A force receiving member 53 is attached between the lock portion 51*c* and the swinging shaft 52. A spring 54, which is biasing means, biases the force receiving member 53 such that the force receiving member 53 projects upward. The biasing force of the spring 54 acts from the force receiving member 53 to the stopping control lever 51, so that the stopping control lever 51 is in a direction in which the inclination portion 51*a* does not apply an external force to the other end sides 23*b* and 24*b* of the levers 23 and 24. It should be noted that although the spring 54, which is a wire spring, is used as a biasing member in this embodiment, it is also possible to use an elastic member.

A stopping lever 55 projects from the upper portion of the frame 50 such that the stopping lever 55 extends along the path on which the carriage 3 travels, substantially in parallel with the stopping control lever 51. A stopper catch 56 as stopping stopper means is provided in the middle of the stopping lever 55, and a catch portion 56*a* on one end side can be hooked on the recess 26*c* of the guide member 26 of the yarn feeder 6, 7. When a roller 56*b* on the other end is guided along the cam groove 40*b* provided on the attachment member 40 of the holder 11, 12, the stopper catch 56 is swingingly displaced using a swinging shaft 56*c* in the middle as a supporting point, and thus the catch portion 56*a* on the one end side of the stopper catch 56 is unhooked from the yarn feeder 6, 7 while the holder 11, 12 passes by the stopping stand 14, 15. More specifically, the stopper catch 56 hooks on the recess 26*c* of the guide member 26 of the yarn feeder 6, 7 when the holder 11, 12 advances, and thus the yarn feeder 6, 7 is prevented from being brought together with the holder 11, 12 with a force applied when the holder 11, 12 advances. Even after unhooking is performed, it is possible to keep the stopping state of the yarn feeder 6, 7 with the stopping control lever 51.

When a lock piece 58 whose inclination can be switched by an actuation piece 57*a* of a bistable solenoid 57 abuts against the lock portion 51*c* of the stopping control lever 51, the force receiving member 53 is pressed, then the stopping control lever 51 presses the other end sides 23*b* and 24*b* of the levers 23 and 24 of the hook mechanism 21, and thus lock to a state in which the hook mechanism 21 is shifted to a non-hook state is possible. The excitation of the solenoid 57 can be performed from the control device 18 in FIG. 1. When the solenoid 57 is excited in a reverse direction, it is possible to swingingly displace the lock piece 58 in the reverse direction, and thus the stopping control lever 51 can be unlocked.

In the stopping stand 14, 15, the stopper catch 56 is unhooked from the yarn feeder 6, 7 by the cam groove 40*b*, but when the pressing portion 45*c* of the holder 11, 12 moves to the position at which the pressing portion 45*c* presses the force receiving member 53, a stopper portion 59 can prevent the yarn feeder 6, 7 from moving. When the yarn feeder 6, 7 moves to the position of the stopper portion 59, it is possible to detect the yarn feeder 6, 7 with a sensor 60 such as a proximity sensor. The detection output of the sensor 60 is input to the control device 18 in FIG. 1. In the weft knitting machine 1, the position of the carriages 3 with respect to the needle beds 2 is always detected, but when the position of the yarn feeder 6, 7 is directly detected, it is possible to confirm the position of the yarn feeder 6, 7 more reliably.

Lever lock means including the stopping control lever 51, the spring 54, the force receiving member 53, the solenoid 57, and the lock piece 58 described above constitutes the switching mechanism 16, 17, which is switching means. From the stopping stand 14, 15, which is stopping means, to one side of the path on which the carriage 3 travels, the stopping control lever 51 of the switching mechanism 16, 17 projects so as to be along the paths. The stopping control lever 51 can slidingly abut against the other end sides 23*b* and 24*b* of the hook mechanism 21 of the yarn feeder 6, 7, which is a removable moving member for knitting that is mounted on travel means. The spring 54 biases the stopping control lever 51 to a direction in which an external force for switching the hook mechanism 21 to a non-hook state is not applied, and thus when the holder 11, 12 of the carriage 3 moves away from the stopping stand 14, 15, the yarn feeder 6, 7 can be mounted on and brought by the holder 11, 12. However, when the carriage 3 travels from one side to the other side on the path, it is possible to stop the yarn feeder 6, 7 at the stopping stand 14, 15 by preventing the yarn feeder 6, 7 from being brought, with the stopper portion 59 provided on the stopping stand 14, 15.

When the carriage 3 moves to the other side on the path and presses the force receiving member 53 against a biasing force of the spring 54, it is possible to swingingly displace the stopping control lever 51 in a direction in which the one side applies an external force for switching the hook mechanism 21 to a non-hook state. When the lever lock means including the solenoid 57 and the lock piece 58 is actuated, the switching is possible such that a state in which the stopping control lever 51 is swingingly displaced with a pressing force to the force receiving member 53 is kept also when the carriage 3 travels in the reverse direction and passes by the stopping stand 14, 15, and thus the yarn feeder 6, 7 is continuously stopped at the stopping stand 14, 15 instead of being mounted on the holder 11, 12 of the carriage 3.

Figure 15:
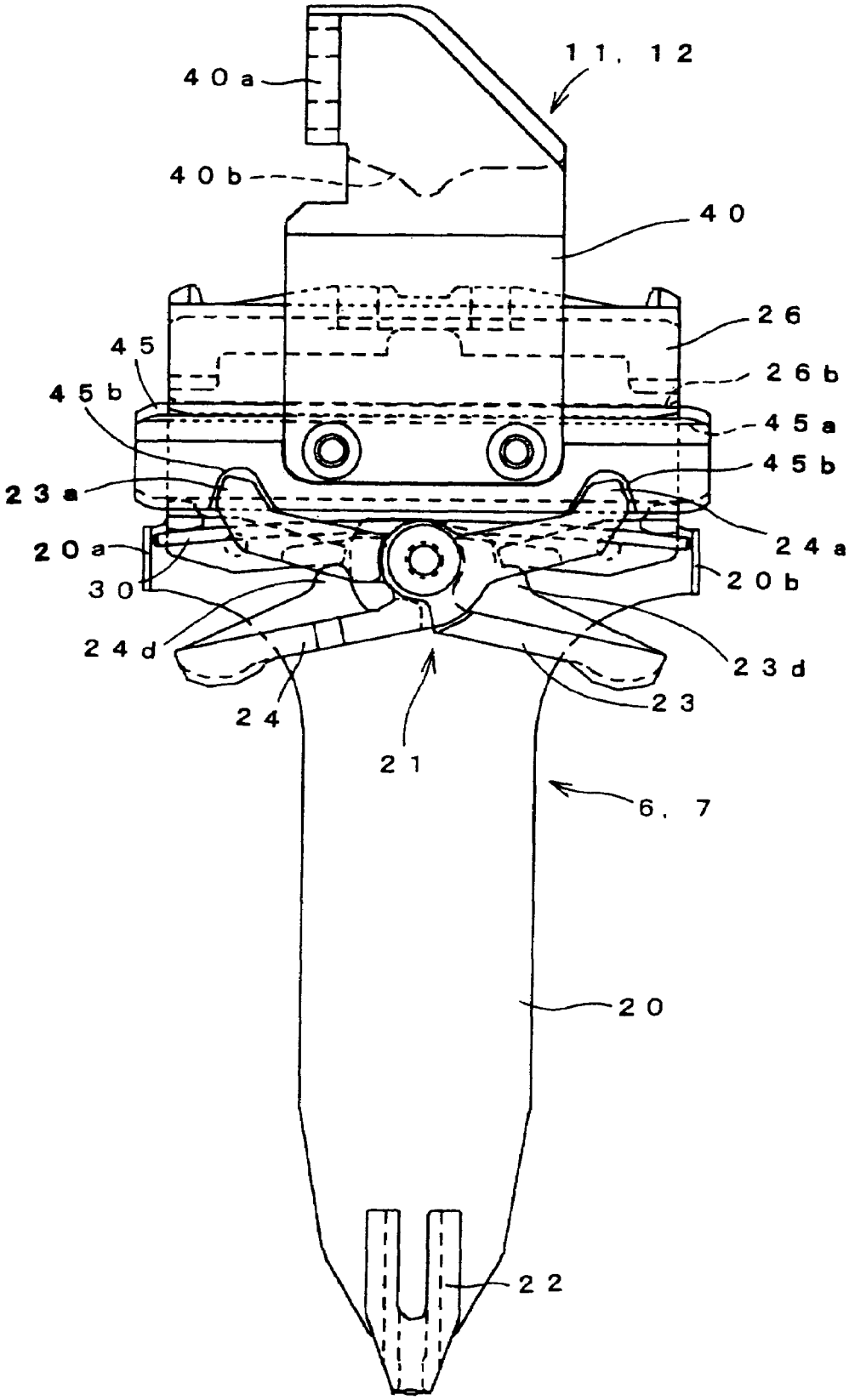
FIG. 15 is a front view showing a brought state in which the yarn feeder 6, 7 is hooked on the holder 11, 12.
Figure 16:
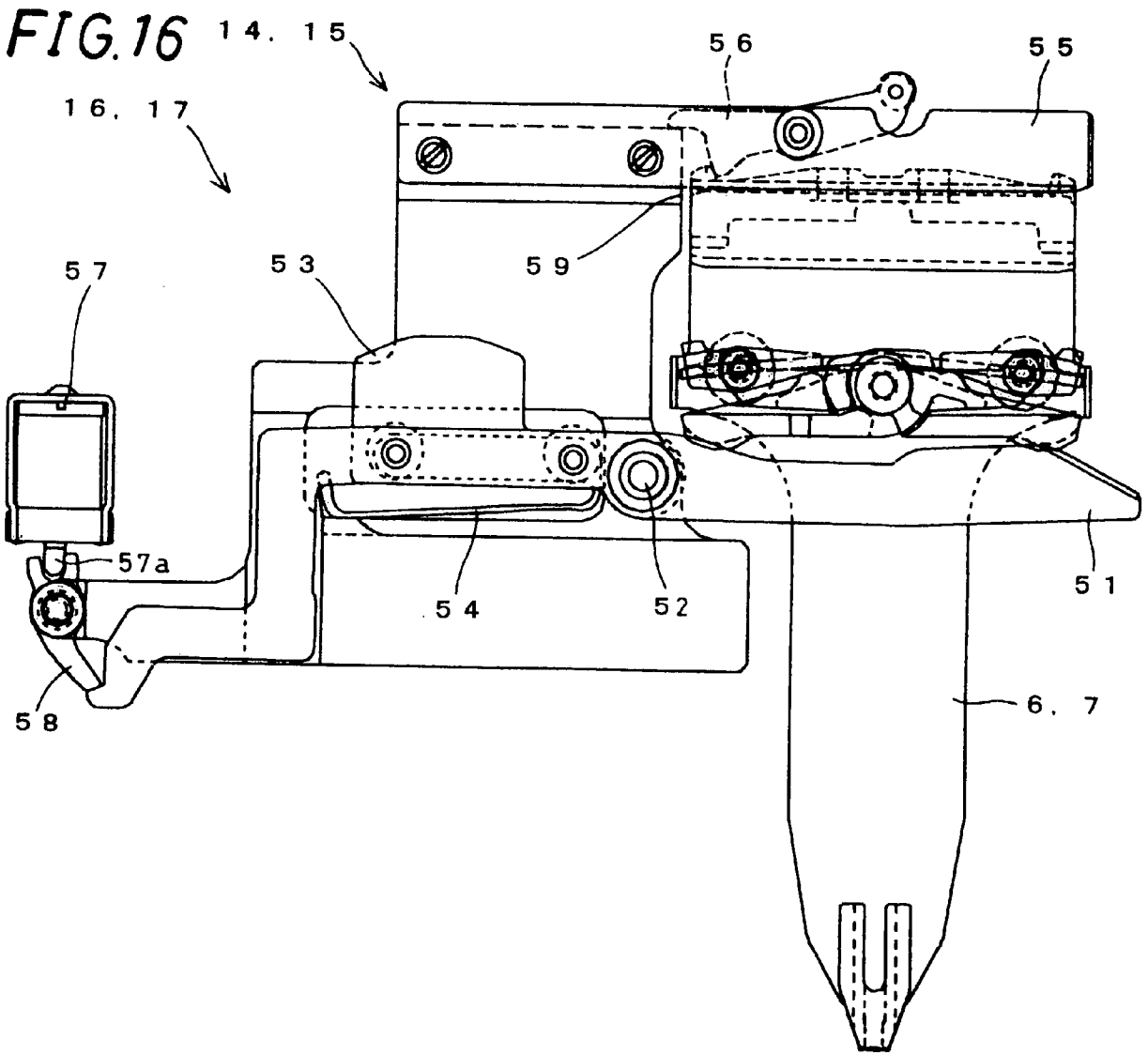
FIG. 16 is a front view showing a stopping state in which the yarn feeder 6, 7 is hooked on the stopping stand 14, 15 with a stopper catch 56.

FIGS. 15 and 16 respectively show front views of a brought state in which the yarn feeder 6, 7 is hooked on the holder 11, 12, and a stopping state in which the yarn feeder 6, 7 is hooked on the stopping stand 14, 15 with the stopper catch 56. In the brought state, with a biasing force applied to the pressing portions 23*d* and 24*d* of the levers 23 and 24 by the wire spring 30, a state is kept in which the one end sides 23*a* and 24*a* of the pair of levers 23 and 24 of the hook mechanism 21 are hooked on the recesses 45*b* of the support member 45 of the holder 11, 12. The stopping state is kept with the hooking of the stopper catch 56 on the recess 26*c* of the guide member 26 of the yarn feeder 6, 7.

FIGS. 17, 18, 19, 20, and 21 show a process in which the holder 11 on which one yarn feeder 6 is mounted moves closer to one stopping stand 14 and the yarn feeder 6 is transferred from the holder 11 to the stopping stand 14.

Figure 17:
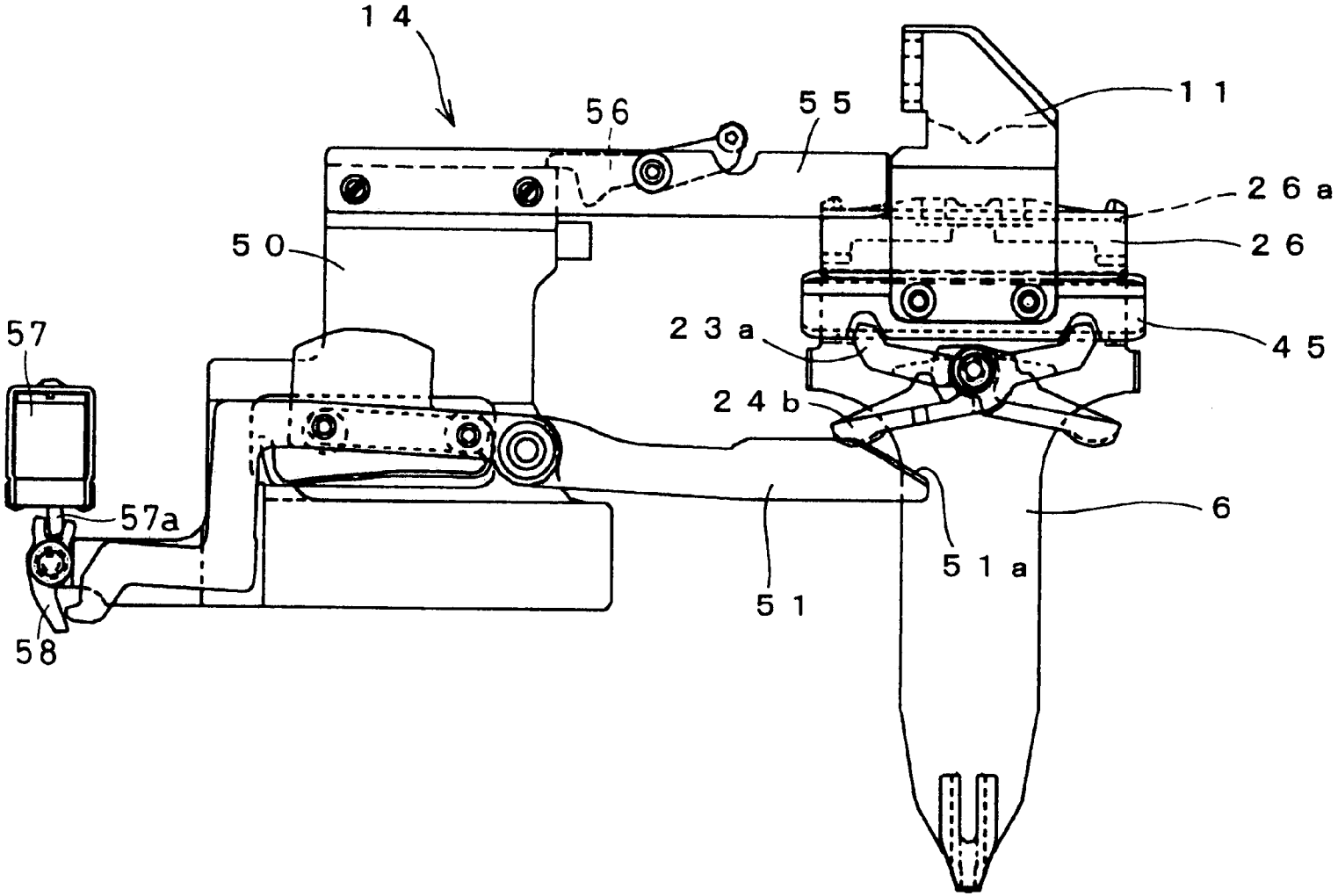
FIG. 17 is a front view showing a process in which the holder 11 on which one yarn feeder 6 is mounted moves closer to one stopping stand 14 and the yarn feeder 6 is transferred from the holder 11 to the stopping stand 14.

In FIG. 17, a state in which the stopping control lever 51 is locked with the solenoid 57 is canceled. When the hook mechanism 21 of the yarn feeder 6 advances between the stopping control lever 51 and the stopping lever 55, the inclination portion 51*a* of the stopping control lever 51 moves into the groove 24*c* of the other end side 24*b* of the lever 24. Furthermore, the lower side on the stopping lever 55 moves into the groove 26*a* that is on the upper side on the guide member 26.

Figure 18:
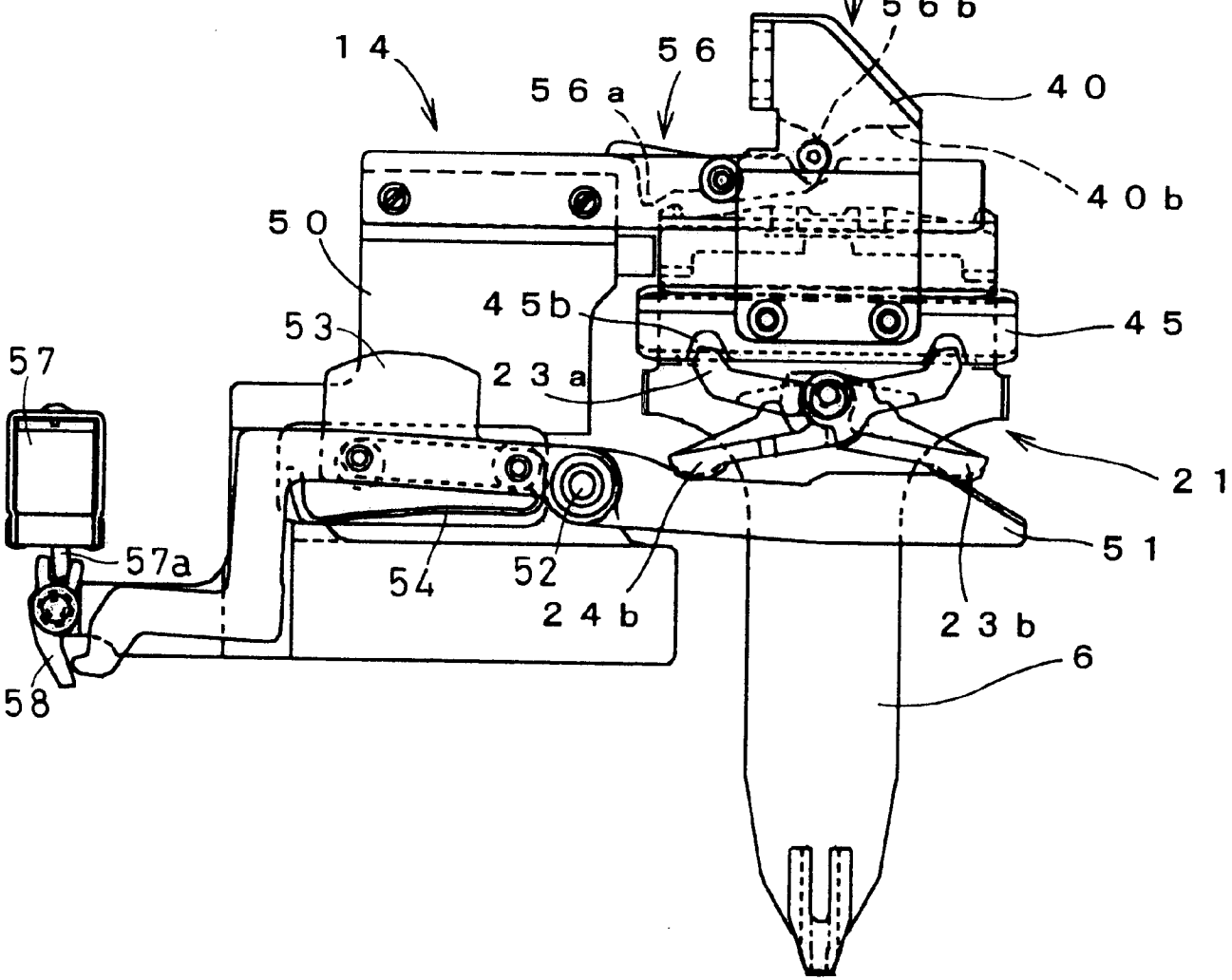
FIG. 18 is a front view showing a process in which the holder 11 on which one yarn feeder 6 is mounted moves closer to one stopping stand 14 and the yarn feeder 6 is transferred from the holder 11 to the stopping stand 14.
Figure 19:
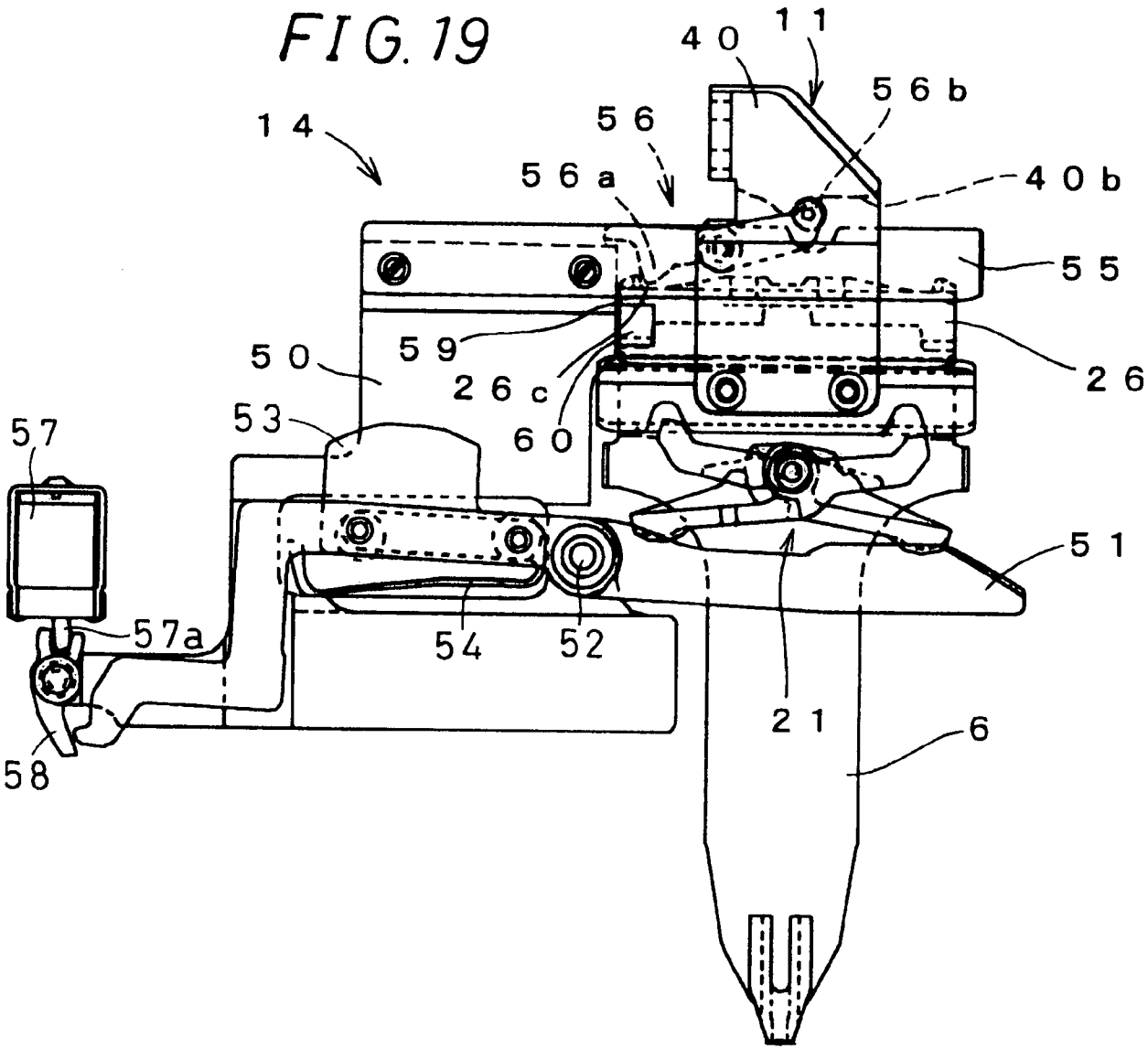
FIG. 19 is a front view showing a process in which the holder 11 on which one yarn feeder 6 is mounted moves closer to one stopping stand 14 and the yarn feeder 6 is transferred from the holder 11 to the stopping stand 14.

In FIG. 18, the roller 56*b* of the stopper catch 56 advances into the cam groove 40*b* of the attachment member 40 of the holder 11, the catch portion 56*a* moves upward, and thus the stopper catch 56 is open. As shown in FIG. 19, when the yarn feeder 6 further advances into the stopping stand 11, the catch portion 56*a* of the stopper catch 56 moves downward, and thus the stopper catch 56 is closed, so that the catch portion 56*a* is fitted to and hooked on the recess 26*c* of the guide member 26.

Figure 20:
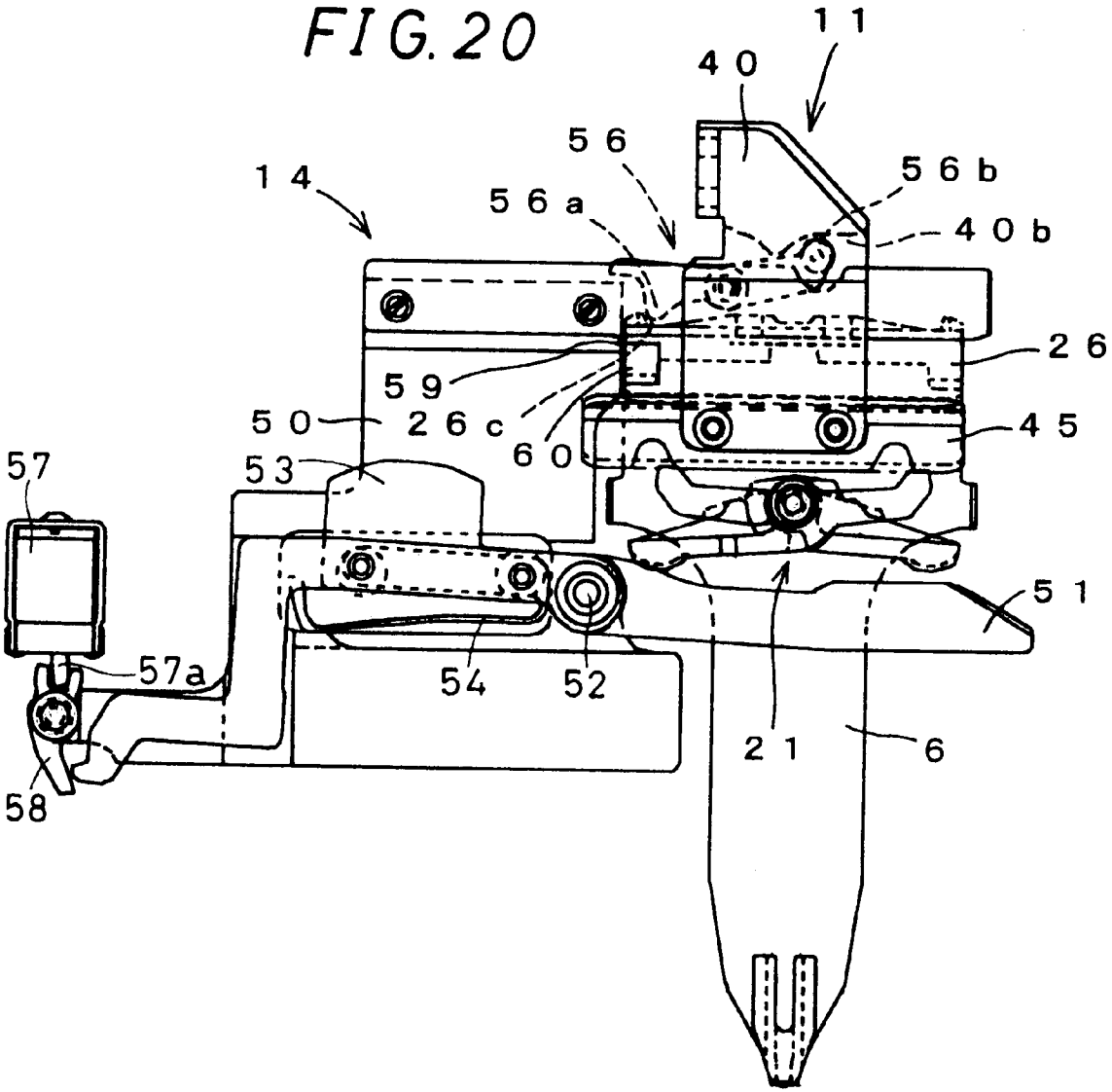
FIG. 20 is a front view showing a process in which the holder 11 on which one yarn feeder 6 is mounted moves closer to one stopping stand 14 and the yarn feeder 6 is transferred from the holder 11 to the stopping stand 14.

As shown in FIG. 20, when the yarn feeder 6 further advances into the stopping stand 11, for example, the left end of the guide member 26 moves closer to the stopper portion 59 of the frame 50 and is detected with the sensor 60. The other end sides 23*b* and 24*b* of the pair of levers 23 and 24 are pressed up by the stopping control lever 51, the one end sides 23*a* and 24*a* is unhooked from the recesses 45*b* of the support member 45 of the holder 11, the hook mechanism 21 is switched to a non-hook state, and the yarn feeder 6 is dismounted from the holder 11.

Figure 21:
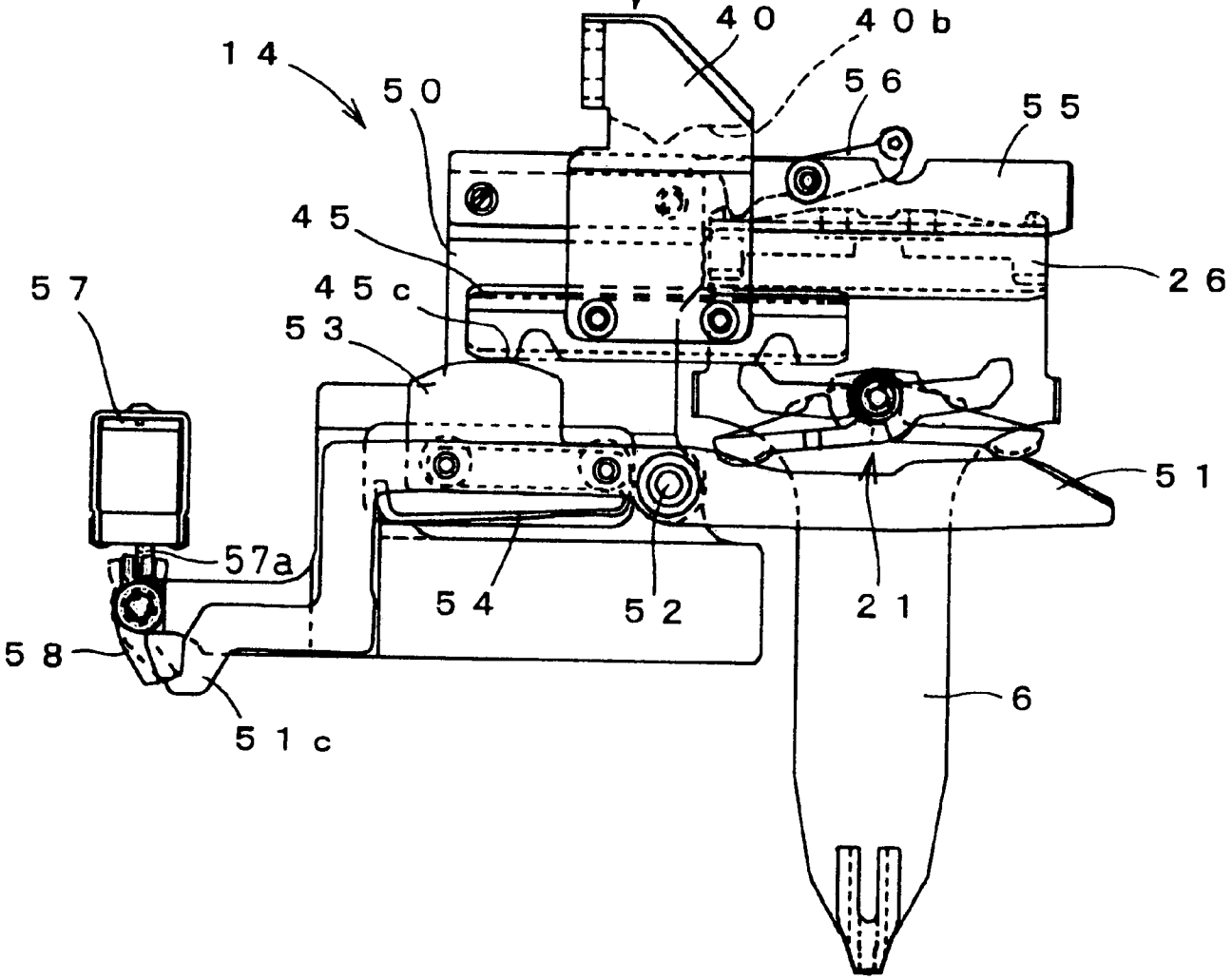
FIG. 21 is a front view showing a process in which the holder 11 on which one yarn feeder 6 is mounted moves closer to one stopping stand 14 and the yarn feeder 6 is transferred from the holder 11 to the stopping stand 14.

As shown in FIG. 21, when the holder 11 continuously moves by continuing the travel of the carriage 3, the yarn feeder 6 is stopped at the position at which the yarn feeder 6 abuts against the stopper portion 59. When the holder 11 is moved to the position at which the pressing portion 45*c* of the support member 45 surmounts and presses the force receiving member 53, the lock portion 51*c* of the stopping control lever 51 is positioned away from the front end position in the swinging displacement of the lock piece 58 of the solenoid 57, and thus it is possible to shift to a lock state by exciting the solenoid 57.

Herein, when the lock using the solenoid 57 is not performed and the carriage 3 is reversed, the yarn feeder 6 is again mounted on and brought by the holder 11 in the reverse order such as FIG. 20, FIG. 19, FIG. 18, and then FIG. 17. As shown in FIG. 20, the stopping control lever 51 can move downward and a force is applied in a direction in which the yarn feeder 6 is pushed out of the stopping stand 14 with the resistance generated when the holder 11 moves. However, until the stopper catch 56 is unhooked by the cam groove 40*b*, the lock state is kept in which the catch portion 56*a* hooks on the recess 26*c* of the guide member 26 of the yarn feeder 6, and thus yarn feeder 6 is not pushed out.

As shown in FIG. 19, when the holder 11 further advances, the stopper catch 56 is gradually unhooked, and the hook mechanism 21 is switched to a hook state and the yarn feeder 6 is mounted on the holder 11. As shown in FIG. 18, in a state where the stopper catch 56 is unhooked, the yarn feeder 6 is fixed on the holder 11 and brought by the carriage 3.

When an empty holder 11 is led to advance toward the stopping stand 14 on which the yarn feeder 6 is stopped as shown in FIG. 16, the stopping control lever 51 is switched to a lock state with the solenoid 57. The holder 11 is led to advance to the position at which the holder 11 surmounts the force receiving member 53 as shown in FIG. 21. In a state where the holder 11 surmounts the force receiving member 53, when the hooking using the solenoid 57 is released and the carriage 3 is reversed, the yarn feeder 6 can be mounted on and brought by the holder 11.

Figure 22:
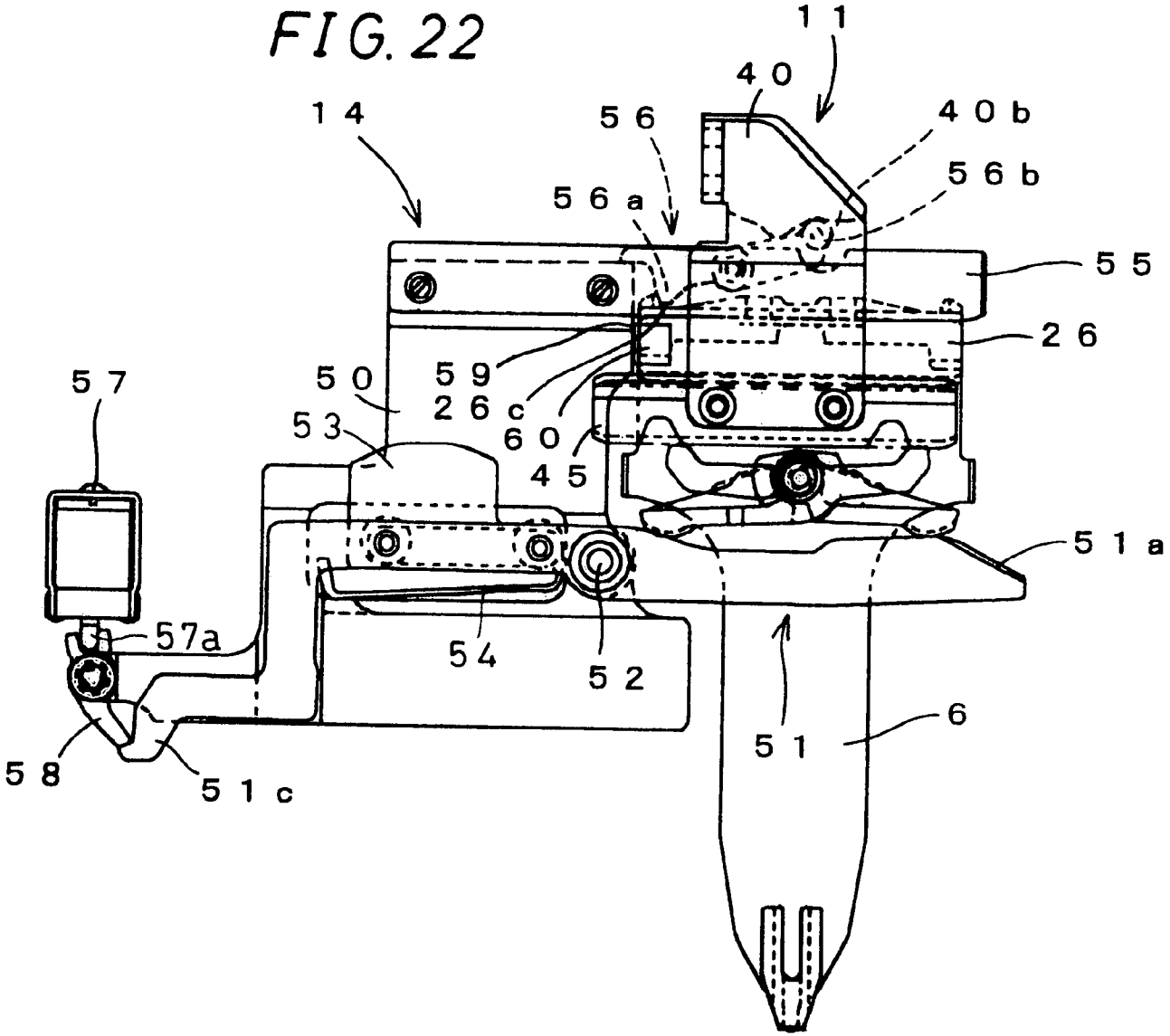
FIG. 22 is a front view showing a process in which the carriage 3 is reversed and the holder 11 is led to pass by the stopping stand 14 in a state where a stopping control lever 51 is locked by actuating a solenoid 57 in FIG. 21.
Figure 23:
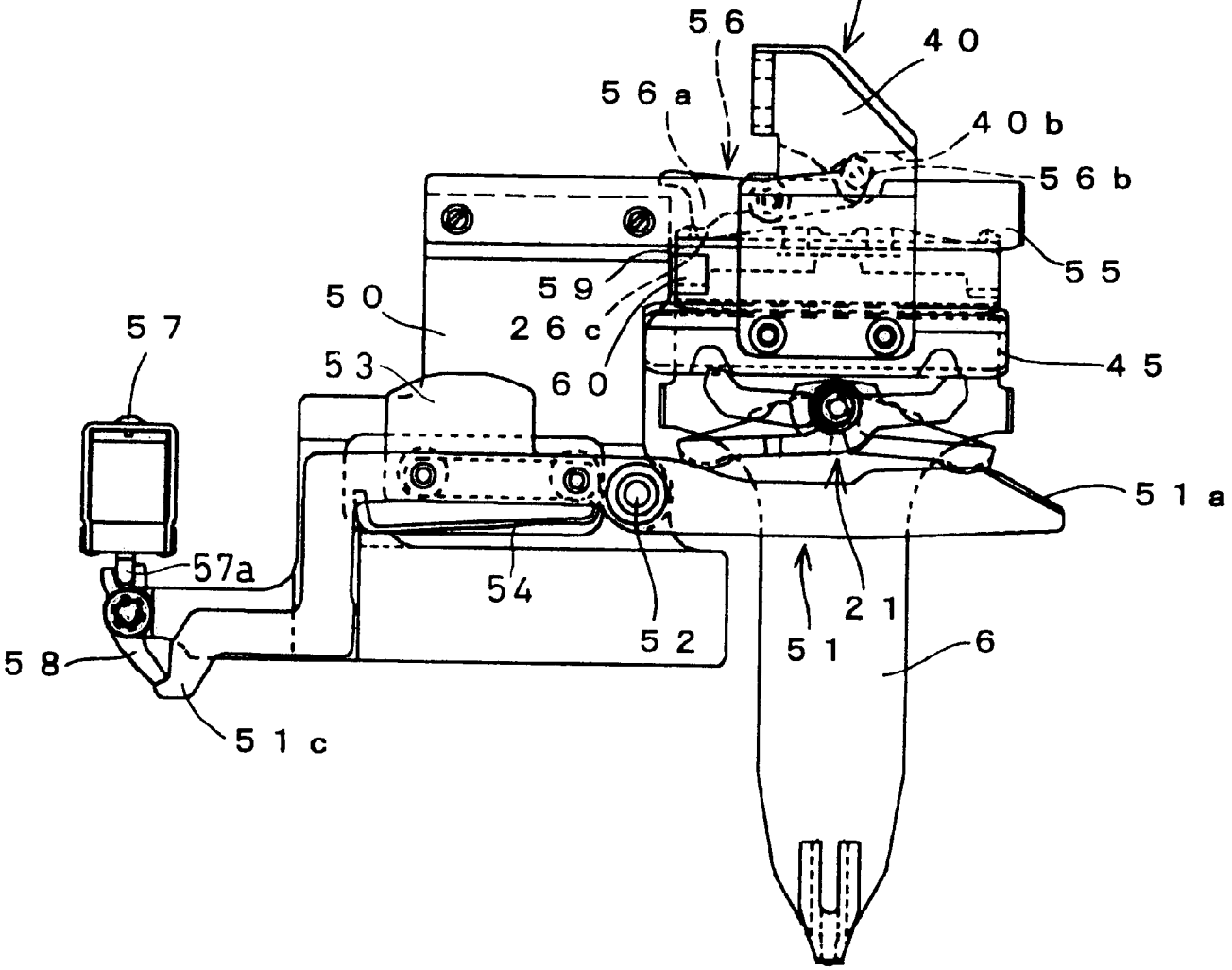
FIG. 23 is a front view showing a process in which the carriage 3 is reversed and the holder 11 is led to pass by the stopping stand 14 in a state where the stopping control lever 51 is locked by actuating the solenoid 57 in FIG. 21.
Figure 24:
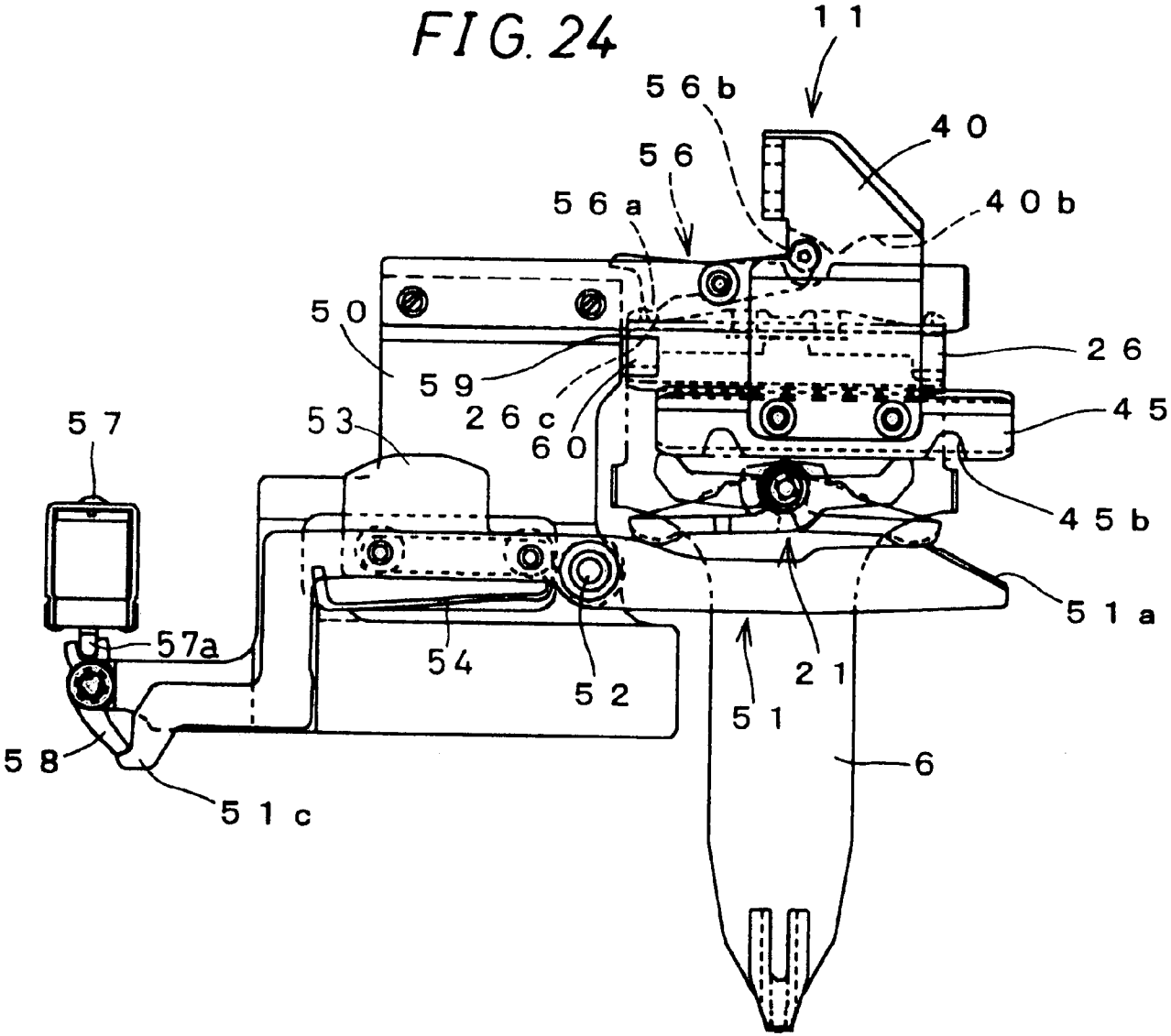
FIG. 24 is a front view showing a process in which the carriage 3 is reversed and the holder 11 is led to pass by the stopping stand 14 in a state where the stopping control lever 51 is locked by actuating the solenoid 57 in FIG. 21.

FIGS. 22, 23, and 24 show a process in which the carriage 3 is reversed and the holder 11 is led to pass by the stopping stand 14 in a state where the stopping control lever 51 is locked by actuating the solenoid 57 in FIG. 21. The inclination portion 51*a* of the stopping control lever 51 is locked at the upper position as shown in FIG. 22, and thus the other end sides 23*b* and 24*b* continuously receive an external force such that the hook mechanism 21 of the yarn feeder 6 is in a non-hook state. With the resistance of the holder 11, a force is applied in a direction in which the yarn feeder 6 is pushed out. However, with the hooking of the stopper catch 56, the yarn feeder 6 is stopped so as not to be pushed out. In FIGS. 23 and 24, the stopper catch 56 is unhooked when the holder 11 passes by the stopping stand 14, but the hook mechanism 21 is in a non-hook state, and thus the yarn feeder 6 is stopped on the side of the stopping stand 14, and the empty holder 11 passes by. Subsequently, the yarn feeder 6 is not brought by the holder 11, and the holder 11 passes by.

In other words, in any of a case in which the yarn feeder 6 that has been brought is again brought, a case in which the yarn feeder 6 that has been brought is left at the stopping stand 14, and a case in which the stopped yarn feeder 6 is brought, the holder 11 advances to the position at which the holder 11 surmounts the force receiving member 53.

It should be noted that although the stopping device 10 is provided only at the left end of the needle beds 2 in FIG. 1, it is possible to provide the device also at the right end. In the stopping device on the left side, it suffices that the configuration of the stopping stands is made symmetric. When the stopping stands 14 are provided on both sides of the needle beds 2 with respect to the holder 11 that is mounted on the carriage 3, it is possible to selectively use one of the two yarn feeders 6. As shown in FIGS. 2 and 3, the plurality of holders 11 and 12, stopping stands 14 and 15 are arranged in a front-to-rear direction, it is possible to selectively use one of the plurality of yarn feeders 6 and 7. When the position of the stopping stands 14 and 15 is shifted along the needle bed 2, it is possible to prevent the front ends (the yarn feeding ports 22) of the yarn feeders 6 and 7 from interfering with each other. Furthermore, when the position of the stopping device 10 can be controllably move to any position in addition to the end portions, it is possible to improve the knitting efficiency. The reason for this is that the distance to the end of a knitted fabric is shortened, and thus the time necessary for moving in order to change the yarn feeders 6 and 7 and other purposes is shortened.

When the yarn feeding position to the needle bed gap 5 is different between the yarn feeders 6 and 7, it is possible to use the plurality of yarn feeders 6 and 7 at the same time. Furthermore, a knitting member such as a fabric presser can be used together with the yarn feeder 6.

Figure 25:
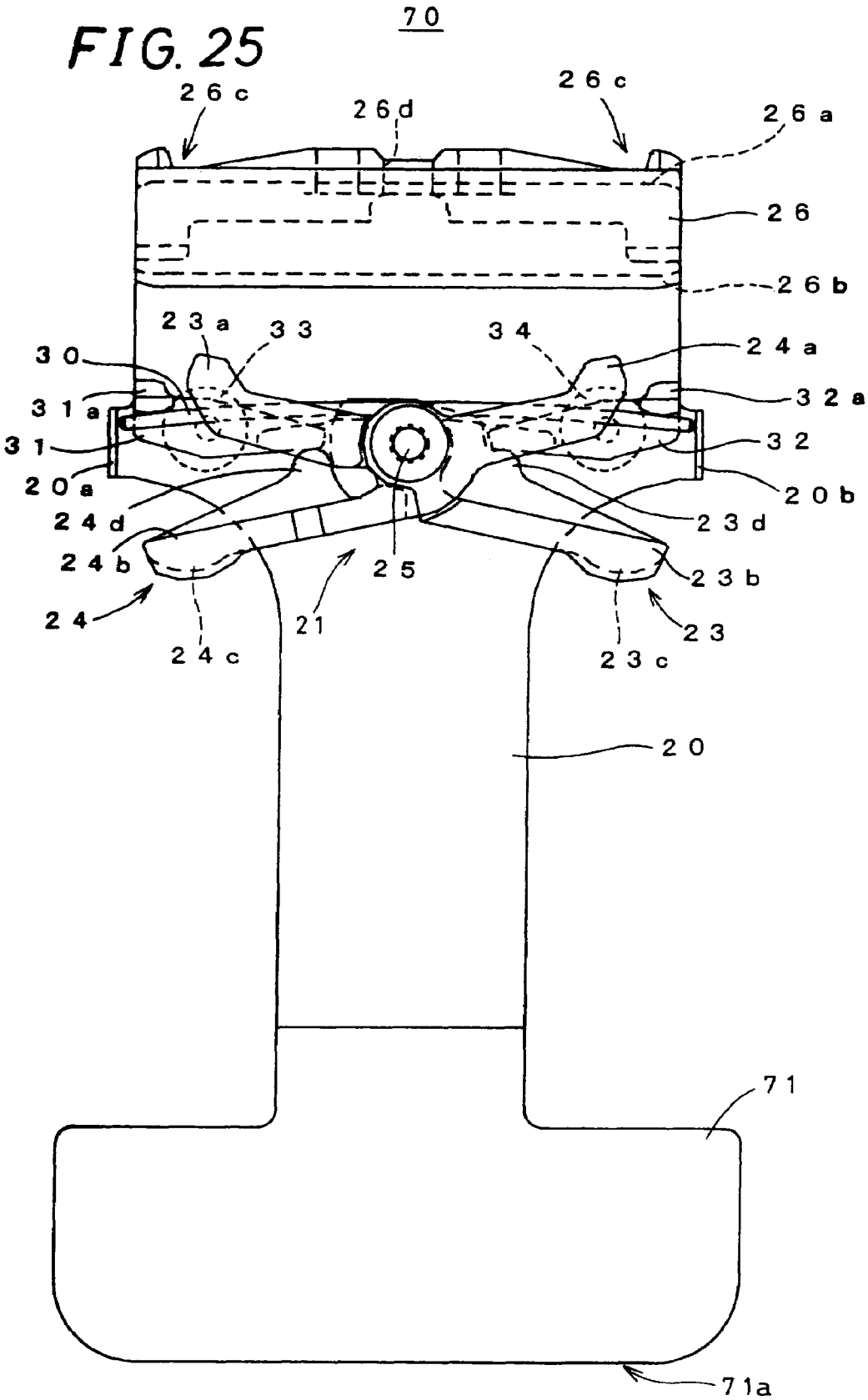
FIG. 25 is a front view showing a schematic configuration of a fabric presser 70 as another example of the removable moving member for knitting.

FIG. 25 shows an example of a fabric presser 70. As the yarn feeder 6, 7, the fabric presser 70 moves together with the holder 11, 12 in a coupled manner. The fabric presser 70 is mounted on and dismounted from the holder 11, 12 with the hook mechanism 21.

The function of the fabric presser 70 is to prevent a knitting stitch from moving upward while a fabric is knitted. A fabric presser plate 71 is provided on the lower side on the fabric presser 70. The fabric presser plate 71 prevents a knitting stitch from moving upward by acting on the rear face of the knitting needles moving upward into the needle bed gap and pressing a knitting stitch with an action face 71*a* at the front end.

More specifically, as the removable moving member for knitting, the yarn feeder 6, 7, for example, has a base end portion and a front end portion, and the base end portion can be mounted on and dismounted from the travel means such as the carriage 3 that travels along the needle bed 2 of the weft knitting machine 1. When the yarn feeding port 22, for example, is provided at the front end portion of the removable moving member for knitting and the base end portion is mounted on the holder 11, 12 that is attached to the carriage 3, an operation of supporting to knit a fabric such as supplying a knitting yarn can be performed at the front end portion. The hook mechanism 21, which is the hook means, and the wire spring 30, which is the biasing means, are provided on the base end portion of the removable moving member for knitting. When mounted on the holder 11, 12, the hook mechanism 21 can be switched between a hook state in which the hook mechanism 21 is hooked via the holder 11, 12 on the carriage 3, and a non-hook state in which the hook mechanism 21 is not hooked on the carriage 3. When mounted on the holder 11, 12, a biasing force of the wire spring 30, which is the biasing means, is applied such that a hook state of the hook mechanism 21 on the holder 11, 12 is kept.

In the hook mechanism 21, displacement in a vertical direction that is perpendicular to the movement of the carriage 3 is possible with a small force such as a force of one-fifth of a hook force, applied to the holder 11, 12 in the hook state, in a longitudinal direction that is in parallel with the movement or the front-to-rear direction that is perpendicular to the movement. When a predetermined external force in the vertical direction is applied to the hook mechanism 21, it is possible to switch from a hook state to a non-hook state against a biasing force of the wire spring 30, so that the removable moving member for knitting can be easily mounted on and dismounted from the holder 11, 12 in a non-hook state, and can be reliably held by switching to a hook state after the mounting. When used as a knitting member such as the yarn feeding port 22, the removable moving member for knitting can be changed with a simple structure, and the mounted knitting member can be firmly held without being bulky. When the removable moving member for knitting is removed from the hook means, it is possible to easily perform, for example, an operation of letting a yarn pass through the yarn feeding port 22 and a maintenance operation.

When the yarn feeder 6, 7 that has a function as the knitting member, as the yarn feeding port 22 supplying a knitting yarn to a knitting needle is used as the removable moving member for knitting, it is possible to knit a fabric while switching knitting yarns of a plurality of colors and various characteristics. When the carriages 3 that travel back and forth along the needle beds 2 and that let the knitting needles 4 arranged side by side on the needle beds 2 perform a knitting operation are used as the travel means, it is possible to make the weft knitting machine 1 smaller by directly mounting the knitting members on the carriages 3 such that it is not necessary to install, for example, yarn guide rails. Since guide rails such as yarn guide rails are not provided, it is not necessary to provide a bringing and switching apparatus such as a bringing pin on the side of the carriages 3, and thus the carriages are prevented from being bulky and heavy, so that the durability is made good even in the weft knitting machine 1 for knitting gloves and others, in which travels are heavily repeated with a small width and at a high speed. Furthermore, it is also possible to eliminate a possibility that the yarn feeding becomes unstable due to yarn guide rails vibrating or being warped, for example, when the frequency at which the carriages 3 travel back and forth becomes high. In addition, yarn guide rails do not occupy the space above the narrow needle bed gap 5, and thus a maintenance operation, for example, can be easily performed.

Furthermore, it is also possible that the travel means travels along paths such as yarn guide rails that are installed above the needle bed gap 5. Even with respect to this travel means, the removable moving member for knitting can be easily changed as the knitting member such as a yarn feeder.

Figure 26:
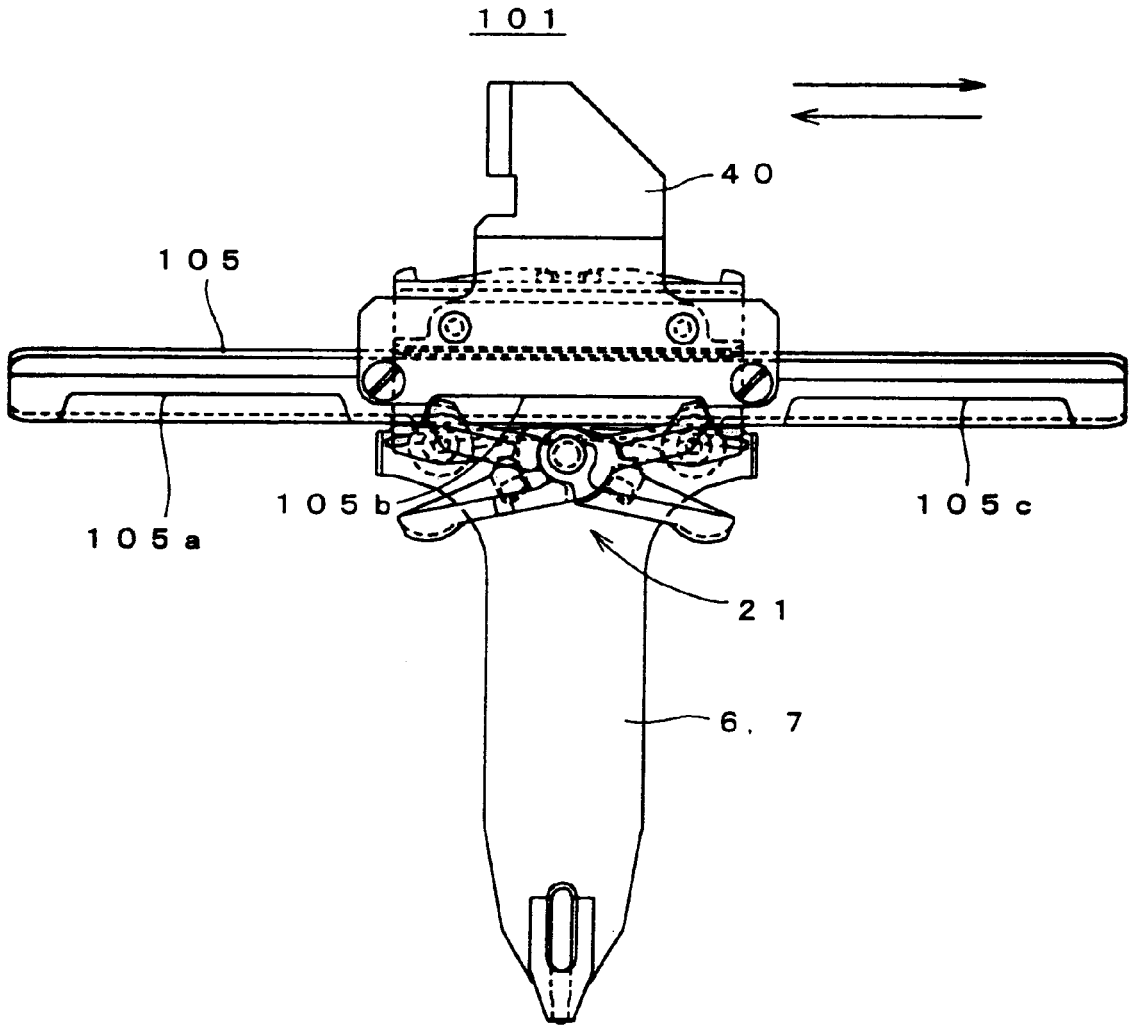
FIG. 26 is a front view showing a schematic configuration of a holder 101 according to another embodiment of the invention.
Figure 27:
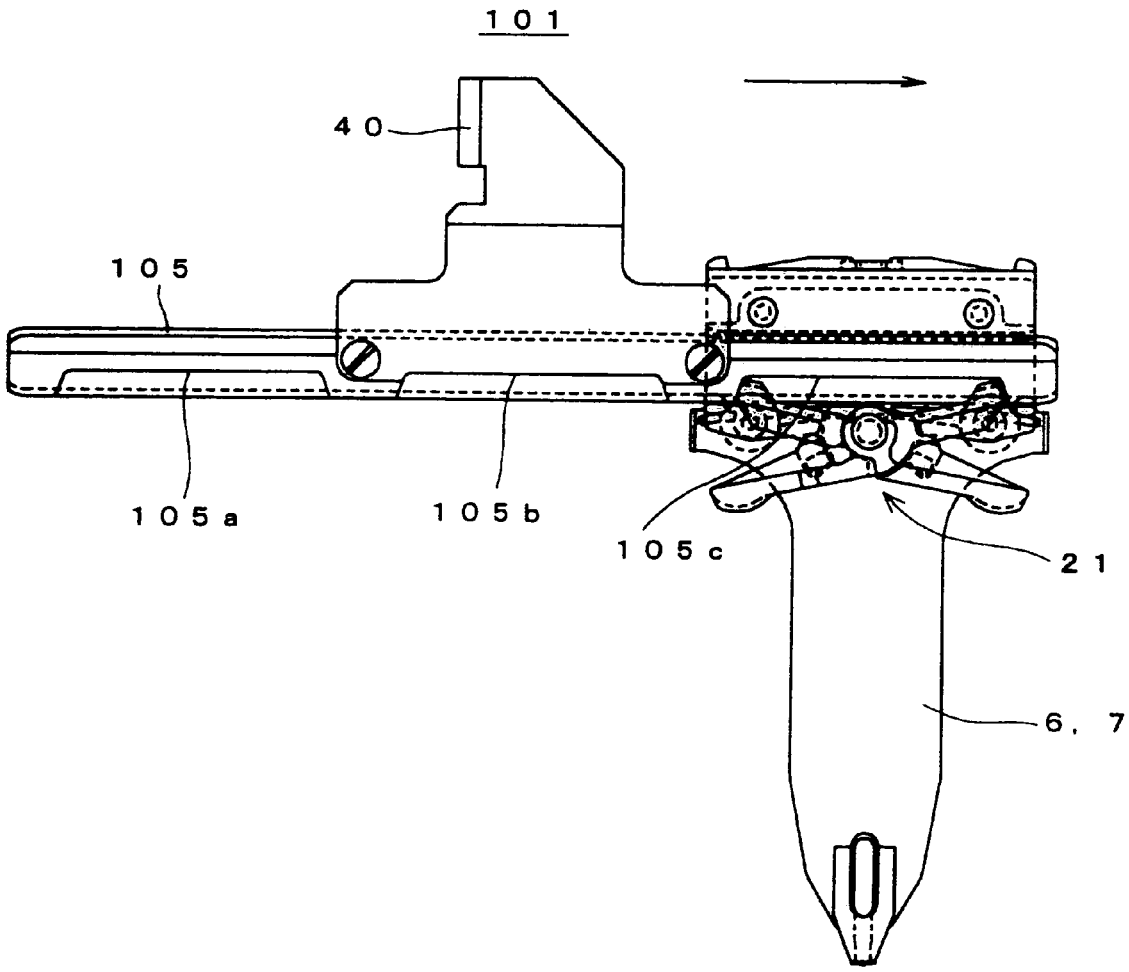
FIG. 27 is a front view showing a schematic configuration of the holder 101 according to another embodiment of the invention.
Figure 28:
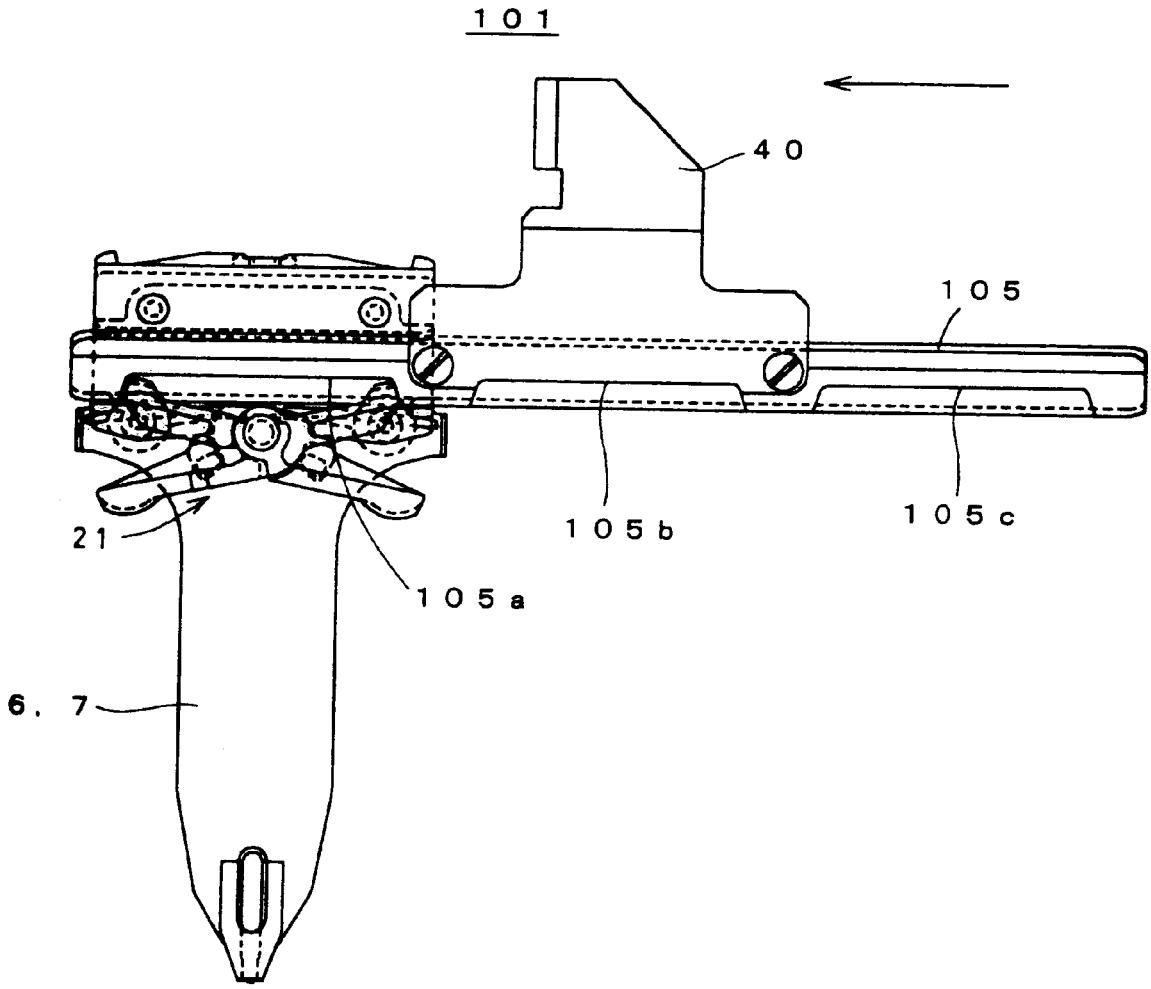
FIG. 28 is a front view showing a schematic configuration of the holder 101 according to another embodiment of the invention.

FIGS. 26, 27, and 28 show a schematic configuration of a holder 101 according to another embodiment of the invention. In this embodiment, the components corresponding to the components described in FIGS. 1 to 25 are denoted by the same reference symbols, and the repeated description thereof has been omitted. A support member 105 of the holder 101 has recesses 105*a*, 105*b*, and 105*c* at three locations, so that the yarn feeder 6, 7 can be selectively hooked. When the yarn feeder 6, 7 is hooked on the middle recess 105*b* as shown in FIG. 26, the yarn feeder 6, 7 can be used for ordinary knitting. When the yarn feeding position switching apparatus 19 is provided on the carriages 3 as shown in FIG. 1, for example, it is possible to switch the yarn feeding position in accordance with a direction in which the carriages 3 travel. The left and right recesses 105*a* and 105*c* that are provided on the support member 105 can be used, for example, when inlaid knitting is performed or other occasions with a shifted yarn feeding position from the yarn feeder 6, 7. When the yarn feeder 6, 7 is hooked on the left recess 105*a* as shown in FIG. 28, it is possible to feed a yarn in advance when the carriage 3 travels to the left. When the yarn feeder 6, 7 is hooked on the right recess 105*c* as shown in FIG. 27, it is possible to feed a yarn in advance when the carriage 3 travels to the right.

Figure 29:
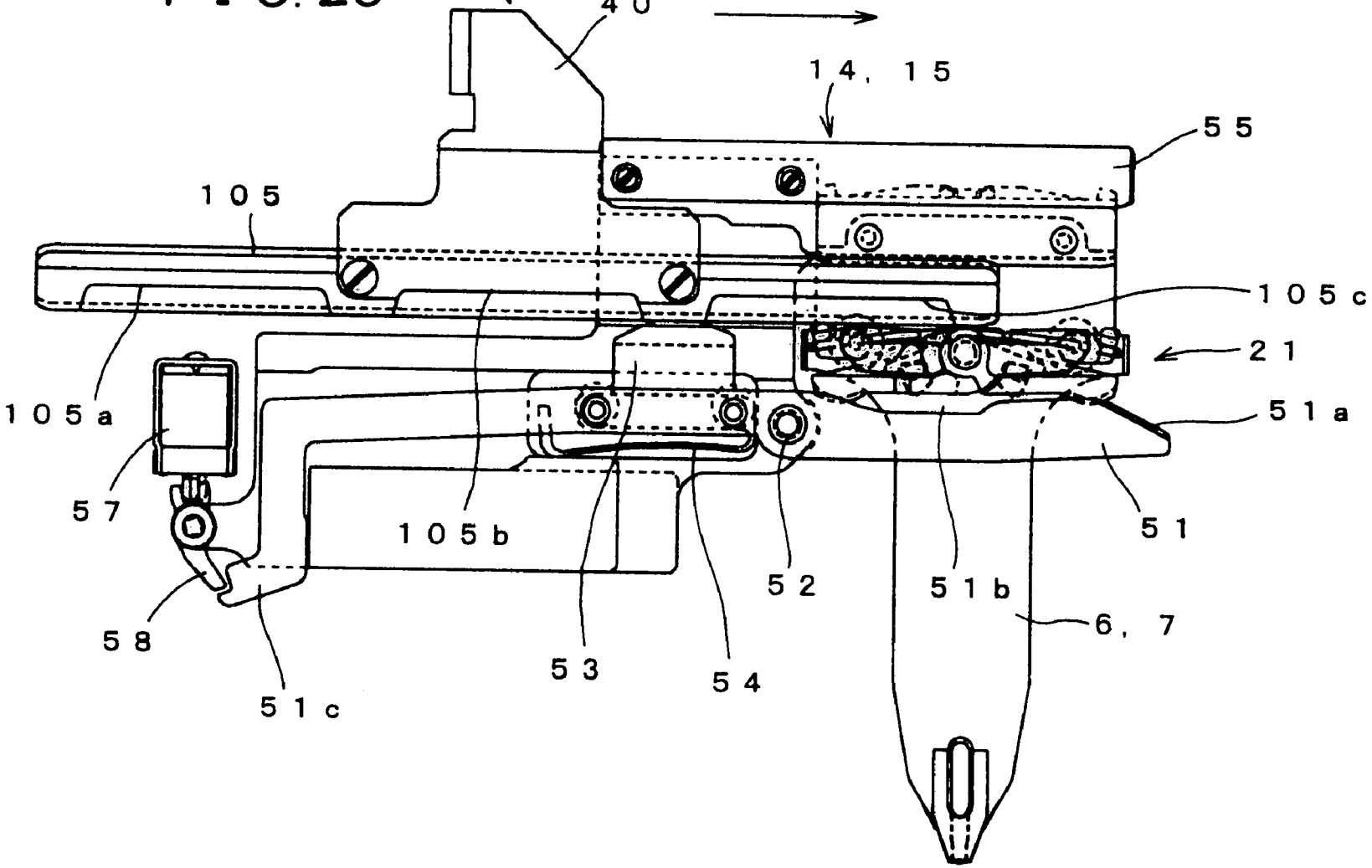
FIG. 29 is a front view showing a control state in which the yarn feeder 6, 7 is stopped by the stopping stand 14, 15 in the embodiment shown in FIGS. 26 to 28.
Figure 30:
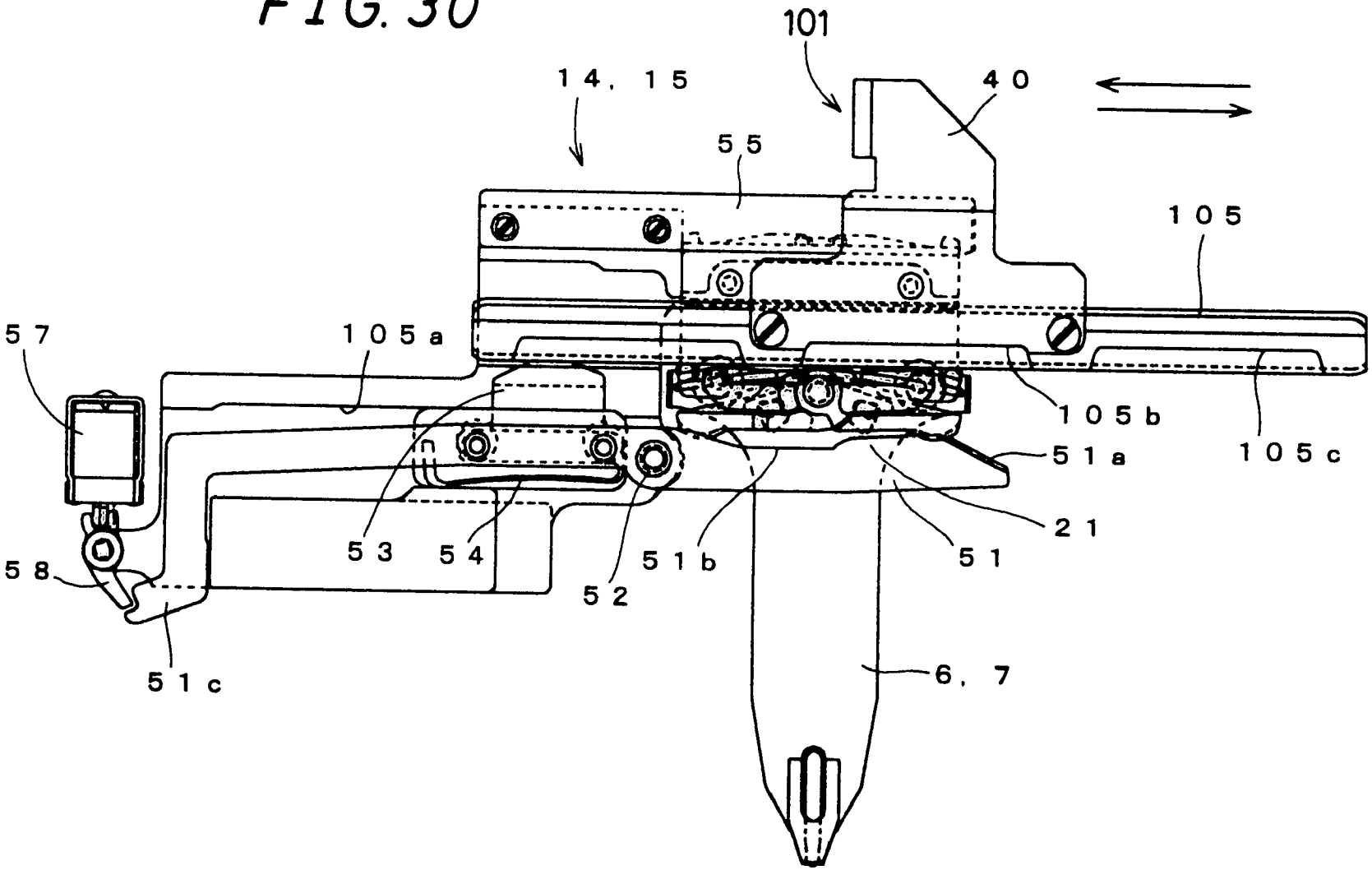
FIG. 30 is a front view showing a control state in which the yarn feeder 6, 7 is stopped by the stopping stand 14, 15 in the embodiment shown in FIGS. 26 to 28.

FIGS. 29 and 30 show a control state in which the yarn feeder 6, 7 is stopped by the stopping stand 14, 15 as shown in FIGS. 13 and 14. When the solenoid 57 is switched to the locking side at a timing when the portion, on which the recesses 105*a*, 105*b*, or 105*c* is not formed, on the bottom portion of the support member 105 presses the force receiving member 53, the yarn feeder 6, 7 can be stopped at the stopping stand 14, 15.

Figure 31:
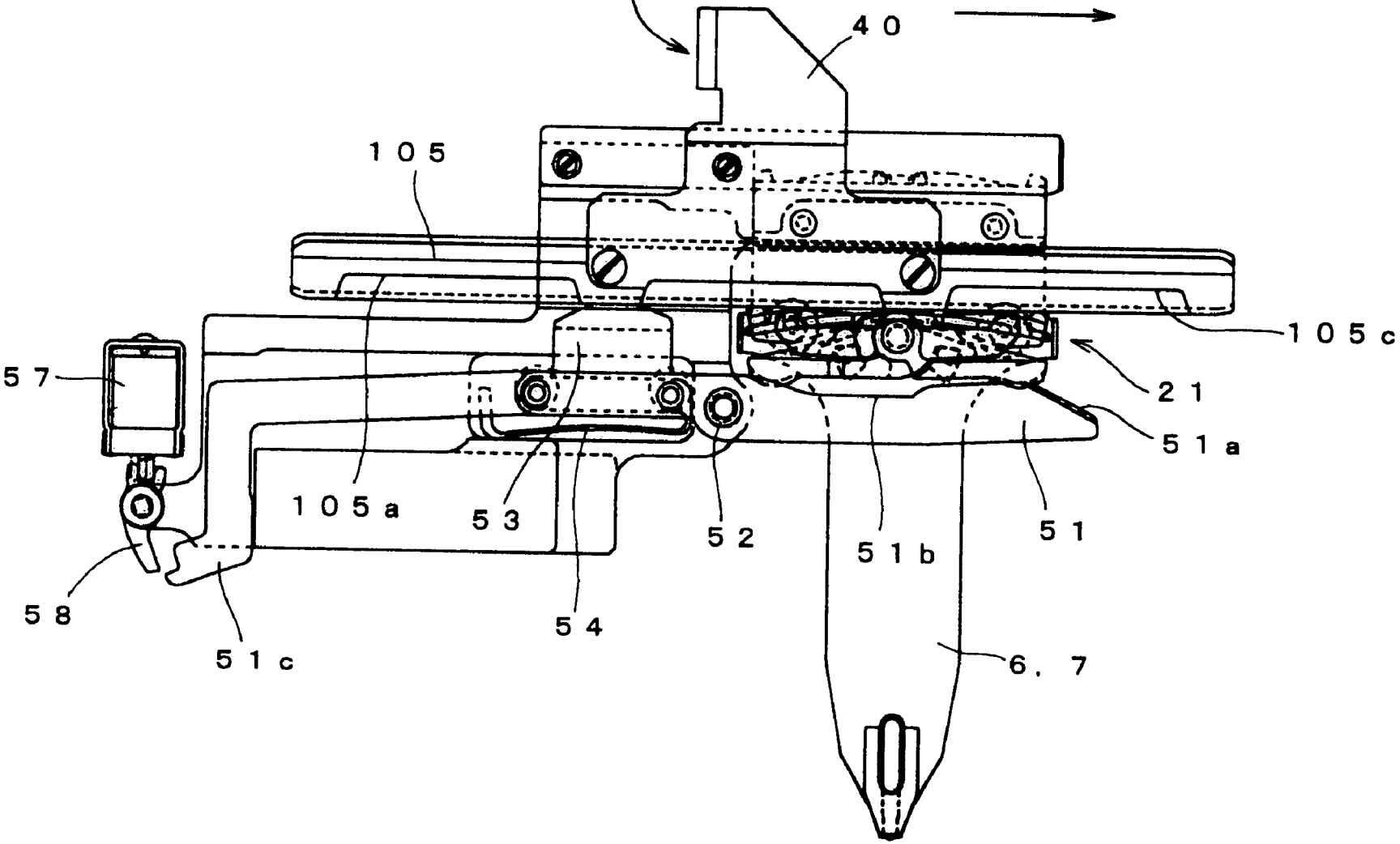
FIG. 31 is a front view showing a control state in which the yarn feeder 6, 7 is hooked on a middle recess 105*b* of a support member 105 in the embodiment shown in FIGS. 26 to 28.
Figure 32:
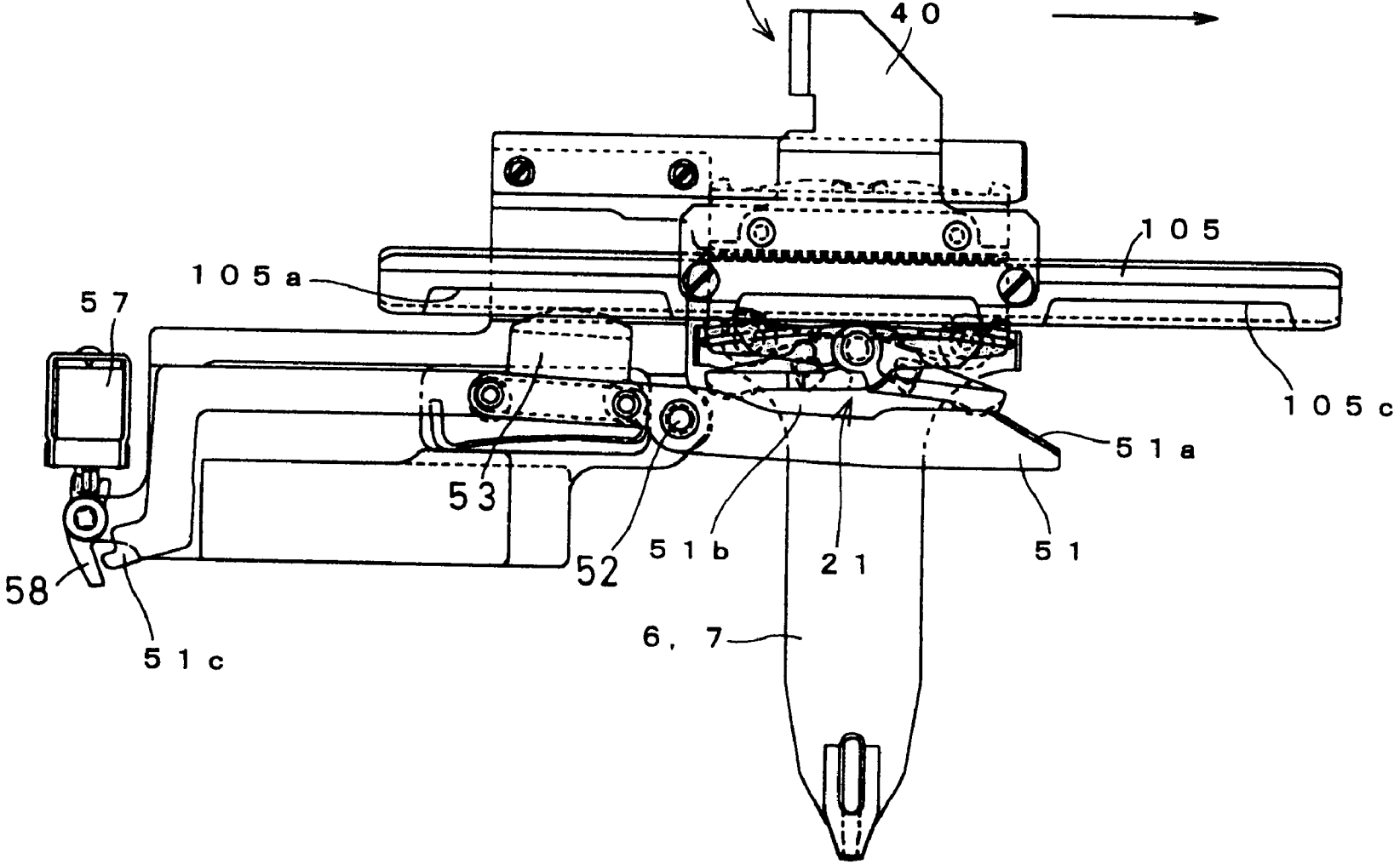
FIG. 32 is a front view showing a control state in which the yarn feeder 6, 7 is hooked on the middle recess 105*b* of the support member 105 in the embodiment shown in FIGS. 26 to 28.

FIGS. 31 and 32 show a control state in which the yarn feeder 6, 7 is stopped at the middle recess 105*b* of the support member 105. When the solenoid 57 is actuated to the unlocking side at a timing when the middle between the recess 105*a* and the recess 105*b* presses the force receiving member 53 as shown in FIG. 31, the yarn feeder 6, 7 can be hooked on the middle recess 105*b* of the support member 105 and be brought by the holder 101 during a process in which the holder 101 moves to the right, as shown in FIG. 32.

Figure 33:
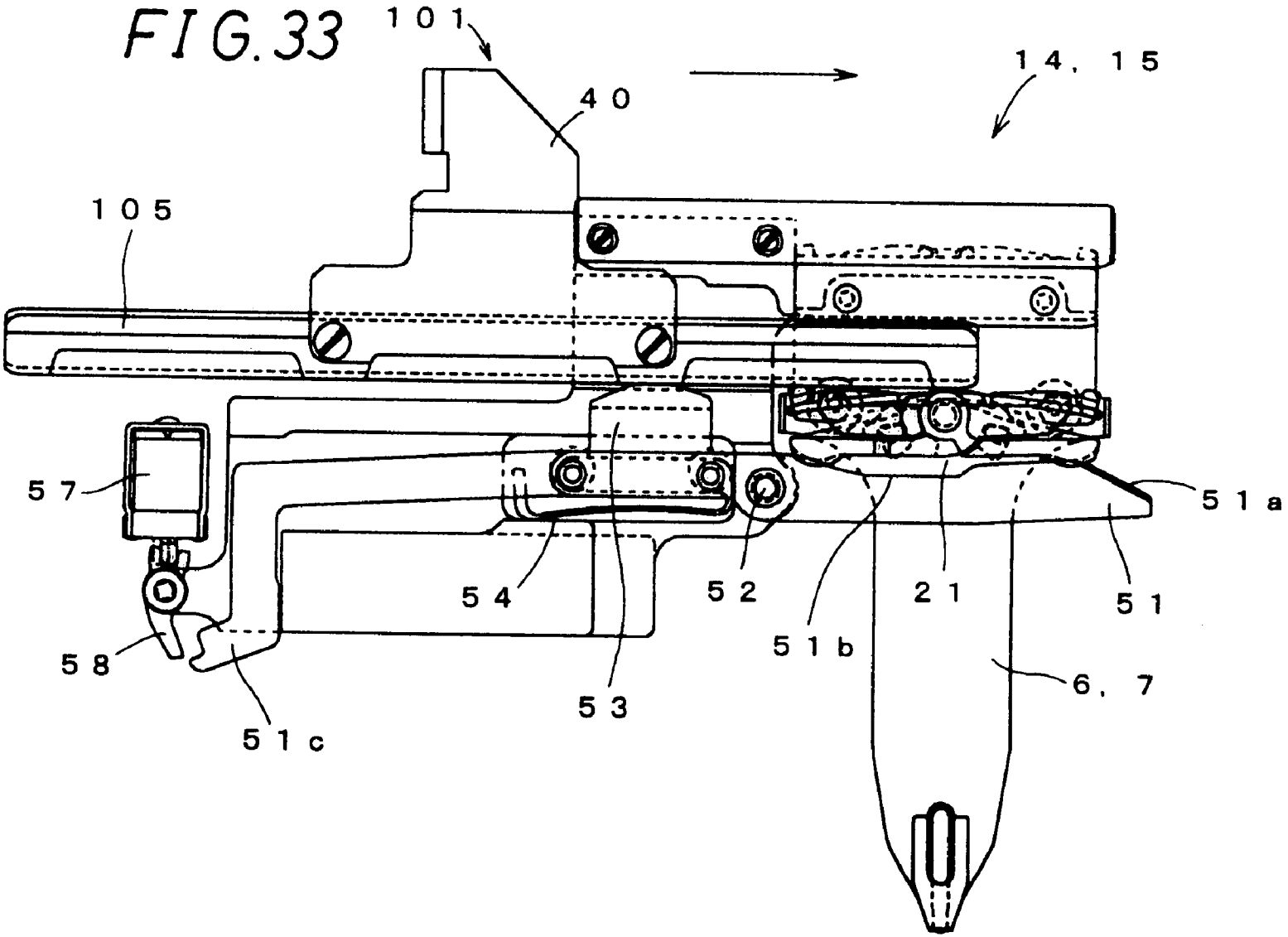
FIG. 33 is a front view showing a control state in which the yarn feeder 6, 7 is hooked on a right recess 105*c* of the support member 105 in the embodiment shown in FIGS. 26 to 28.
Figure 34:
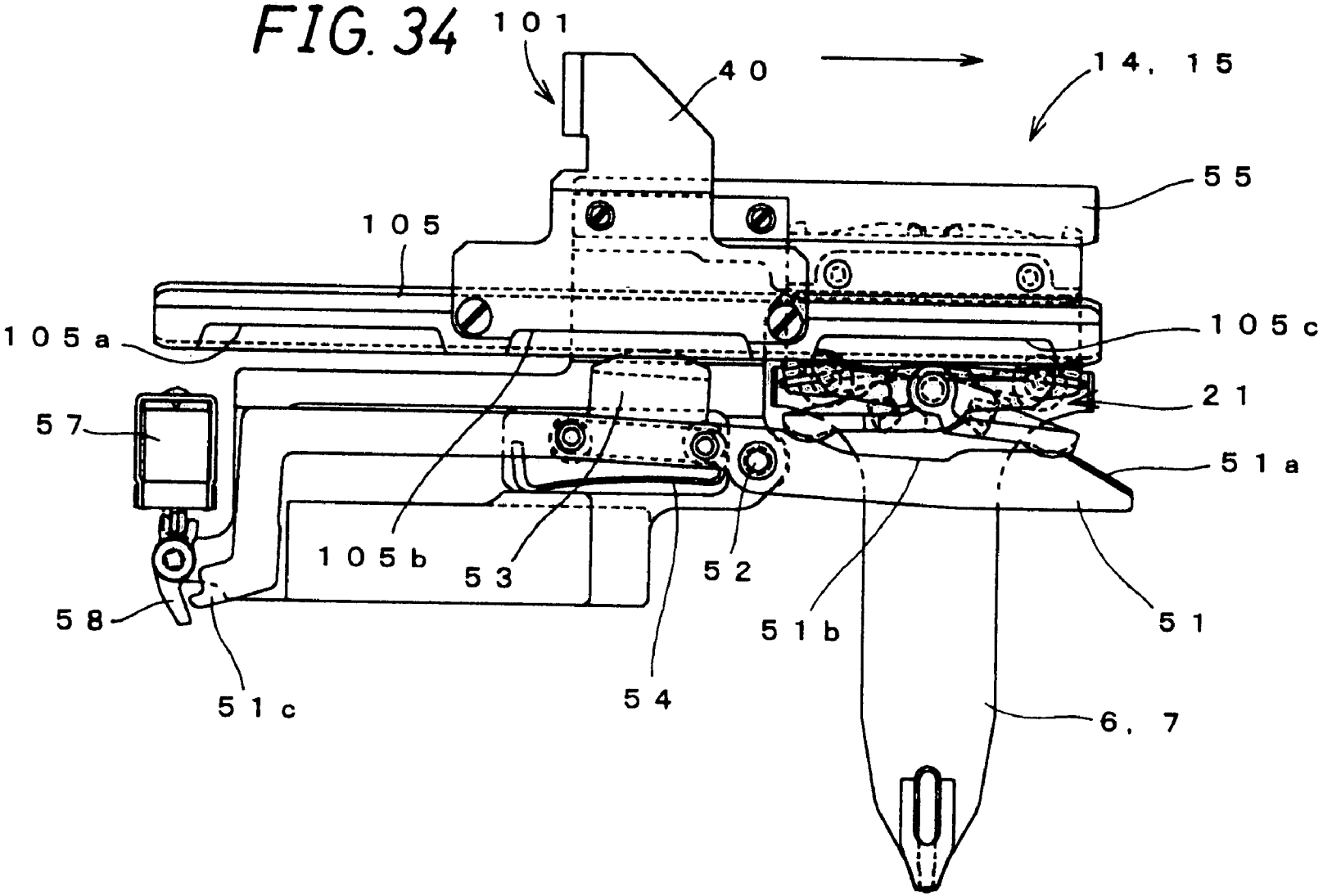
FIG. 34 is a front view showing a control state in which the yarn feeder 6, 7 is hooked on the right recess 105*c* of the support member 105 in the embodiment shown in FIGS. 26 to 28.

FIGS. 33 and 34 show a control state in which the yarn feeder 6, 7 is hooked on the right recess 105*c* of the support member 105. When the solenoid 57 is actuated to the unlocking side at a timing when the middle between the recess 105*b* and the recess 105*c* presses the force receiving member 53 as shown in FIG. 33, the yarn feeder 6, 7 can be hooked on the right recess 105*c* of the support member 105 and be brought by the holder 101 during a process in which the holder 101 moves to the right as shown in FIG. 34. This position is used for inlaid knitting to the right. In a similar manner, it suffices that the yarn feeder 6, 7 is hooked on the left recess 101*a* for inlaid knitting to the left.

Figure 35:
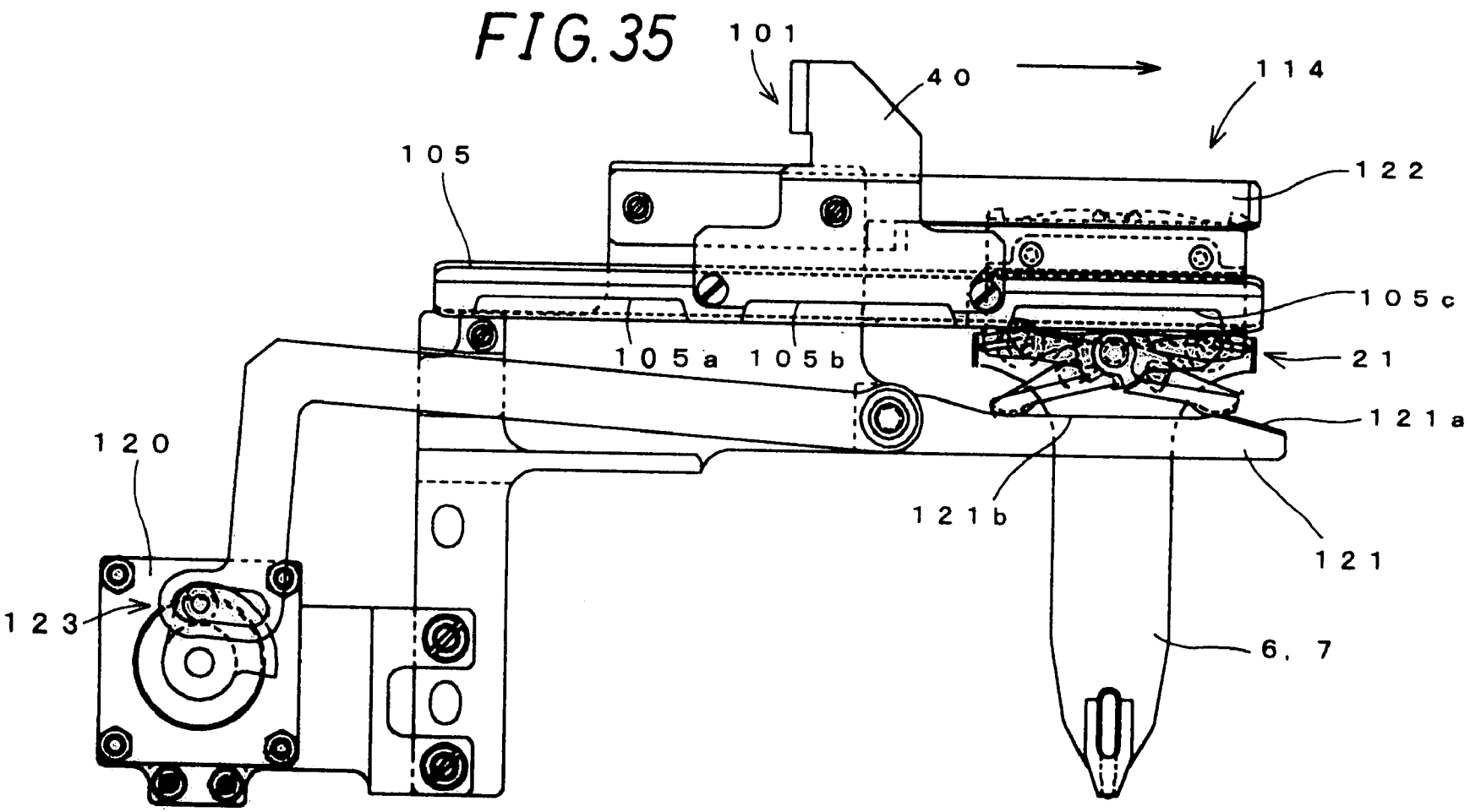
FIG. 35 is a front view showing a schematic configuration of a stopping stand 114 as another embodiment of the invention.
Figure 36:
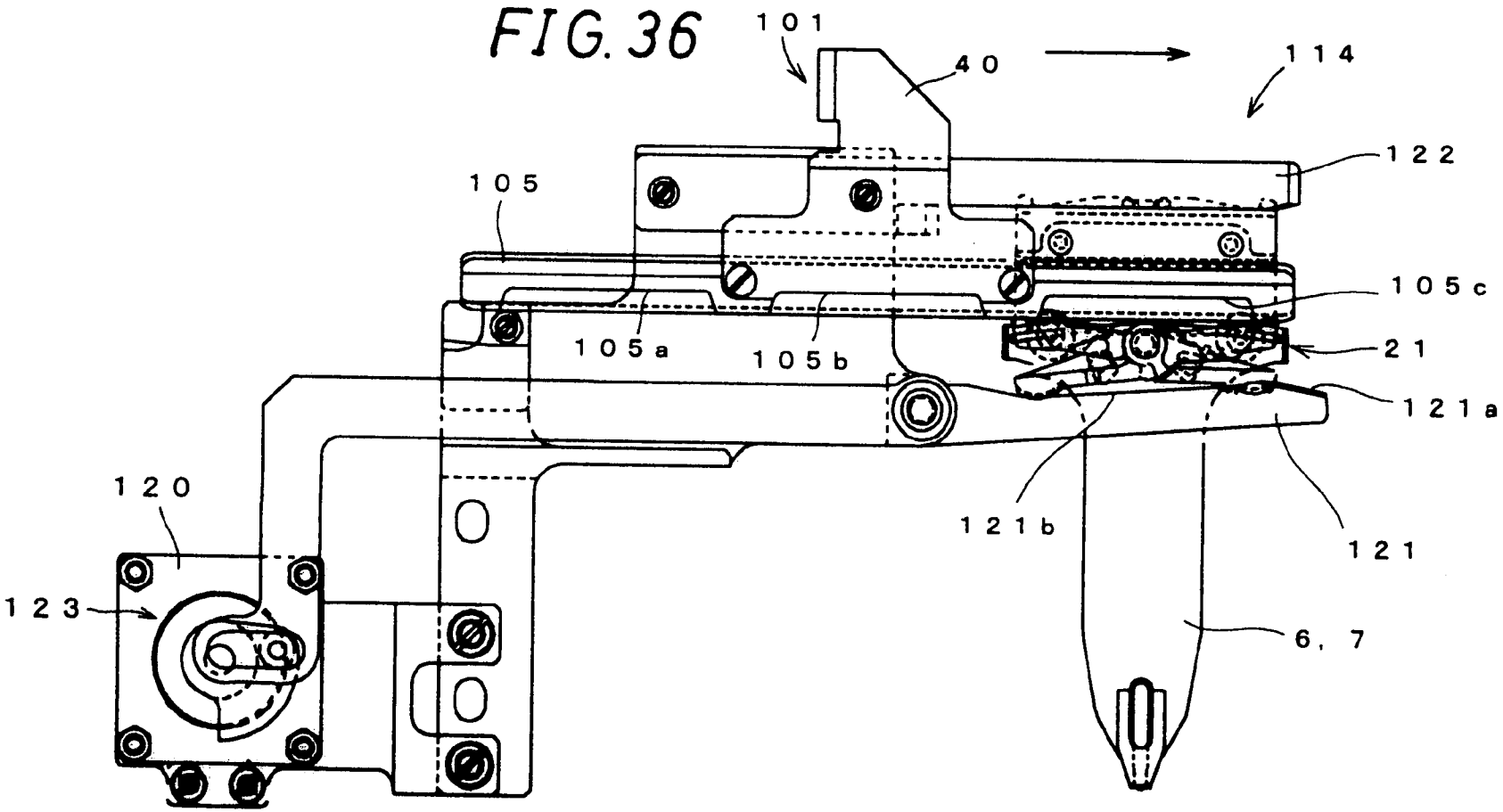
FIG. 36 is a front view showing a schematic configuration of the stopping stand 114 as another embodiment of the invention.

FIGS. 35 and 36 show a schematic configuration of a stopping stand 114 as another embodiment of the invention. FIGS. 35 and 36 respectively correspond to FIGS. 13 and 14. More specifically, FIG. 35 shows a state in which an external force for switching the hook mechanism 21 of the yarn feeder 6, 7 to a non-hook state does not act, and FIG. 36 shows a state in which lock is performed such that an external force for switching the hook mechanism 21 to a non-hook state acts. In the stopping stand 114, a stopping control lever 121 is swingingly displaced by a motor 120, which is an actuator. The right side that is one side of the stopping control lever 121 is similar to the stopping control lever 51 in FIGS. 13 and 14, and is provided with an inclination portion 121*a* that is similar to the inclination portion 51*a*, and the middle is provided with a recess 121*b* that is similar to the recess 51*b*.

A stopping lever 122 that is similar to the stopping lever 55 is provided above the stopping control lever 121. A driving force from the motor 120 is transmitted via a cam mechanism 123 to the left side that is the other side on the stopping control lever 121. The swinging state of the stopping control lever 121 can be feely switched anytime when the motor 120 is driven.

Figure 37:
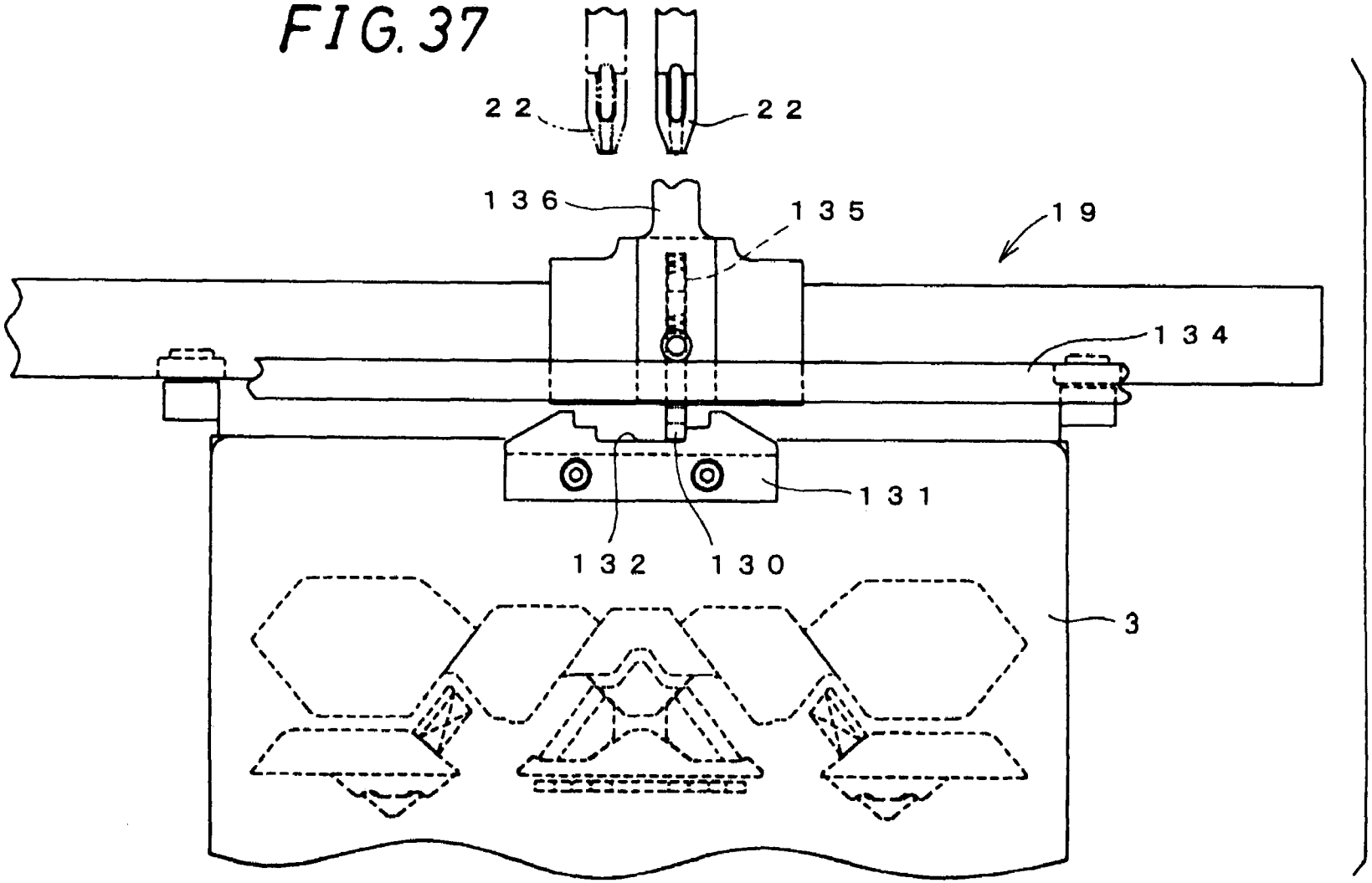
FIG. 37 is a simplified front view showing a schematic configuration of a yarn feeding position switching apparatus 19 that can be used in embodiments of the invention.

FIG. 37 shows an example of the yarn feeding position switching apparatus 19 for switching the yarn feeding position between a right travel and a left travel of the carriage 3, when the yarn feeder 6, 7 is used at the ordinary position in the embodiments described above. The yarn feeding position can be switched when a bringing pin 130 abuts against the left end or the right end of a recess 132 that is formed on a receiving member 131 in accordance with a direction in which the carriage 3 travels. It should be noted that a state in which the bringing pin 130 projects can be switched between various states when a tab 133 is pressed up by a control bar 134 and a biasing force of a spring 135 is applied such that the tab 133 is pressed down. When the recess 132 is formed so as to have the depth of a plurality of stages, it is possible to switch the yarn feeding position between a plurality of stages. The coupling with the holder 11, 12, 101 in the embodiments is made via a gate member 136.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

According to the invention, when a predetermined external force is applied to hook means of a removable moving member for knitting, it is possible to switch from a hook state in which the hook means is mounted on the travel means while hooking a support member provided in the hook means by sandwiching the support member in a vertical direction to a non-hook state, and thus the removable moving member for knitting can be easily mounted on and dismounted from travel means, and can be reliably held by keeping a hook state after the mounting by biasing with a spring by the biasing means. When used as a knitting member such as a yarn feeding port, the removable moving member for knitting can be changed with a simple structure, and the mounted knitting member can be firmly held without being bulky. When the removable moving member for knitting is removed from the hook means, a rail for traveling is not used, and therefore it is possible to easily perform, for example, an operation of letting a yarn pass through the yarn feeding port and a maintenance operation.

Furthermore, according to the invention, it is possible to switch between a hook state and a non-hook state by hooking travel means on one end sides of a pair of levers that intersect each other in the middle in the shape of an X and that can be swingingly displaced around an intersecting portion, and by opening and closing the one end sides when the other end sides receive a predetermined external force. A spring biases the other end sides of the levers such that the one end sides of the levers move closer to each other, and thus it is possible to keep a hook state on the travel means in a direction in which the one end sides of the levers are closed.

Furthermore, according to the invention, a spring can reliably bias the hook means with a simple structure in which only a wire-shaped spring or a plate-shaped spring is used.

Furthermore, according to the invention, in a weft knitting machine provided with a knitting member switching apparatus, the knitting member switching apparatus can switch between a state in which the removable moving member for knitting is mounted on a holder as a knitting member and is brought by the travel means and a state in which the removable moving member for knitting is stopped by stopping means, when the travel means passes by the stopping means. By applying or not applying an external force to the hook means that is provided on the removable moving member for knitting, the removable moving member for knitting as the knitting member can be transferred between the travel means and the stopping means, and thus the removable moving member for knitting such as the yarn feeding port can be changed with a simple structure, and the mounted knitting member can be firmly held without being bulky. When the knitting member is removed from the holder of the hook means, it is possible to easily perform, for example, an operation that is necessary for a knitting operation and a maintenance operation.

Furthermore, according to the invention, the holder has a plurality of positions on which the removable moving member for knitting can be mounted, and the knitting member switching apparatus mounts the removable moving member for knitting on the holder by selecting one from the plurality of positions, and thus in accordance with the mounting position, the switching can be performed with shifted phase relationship between the operation of the knitting needles and the action of the moving member for knitting.

Furthermore, according to the invention, from the stopping means to one side of a path on which the travel means travels, a stopping control lever, which is switching means, projects so as to be along the path. The stopping control lever can slidingly abut against the other sides on the hook means of the removable moving member for knitting that is mounted on the travel means. The biasing member biases the stopping control lever to a direction in which an external force for switching the hook means to a non-hook state is not applied, and thus when the holder of the travel means moves away from the stopping means, the removable moving member for knitting can be mounted on and brought by the holder. However, when the travel means travels from one side to the other side on the path, it is possible to stop the removable moving member for knitting at the stopping means by preventing the removable moving member for knitting from being brought, with a stopper portion provided on the stopping means. When the travel means moves to the other side and presses a force receiving member, against a biasing force of the spring, it is possible to swingingly displace the stopping control lever in a direction in which the one side applies an external force for switching the hook means to a non-hook state. When lever lock means is actuated, the switching is possible such that a state in which the stopping control lever is swingingly displaced with a pressing force to the force receiving member is kept also when the travel means travels in the reverse direction and passes by the stopping means, and thus the removable moving member for knitting is continuously stopped at the stopping means instead of being mounted on the holder of the travel means. A driving force that is necessary for the lever lock means can be made small, and thus the apparatus can be made smaller.

Furthermore, according to the invention, an actuator for switching the stopping control lever between a state in which an external force for switching the hook means to a non-hook state is not applied and a state in which the external force is applied is provided, and thus it is possible to switch the hook means by actuating the stopping control lever with the operation of the actuator.

Furthermore, according to the invention, even when the holder advances while the removable moving member for knitting is stopped, stopping stopper means prevents there movable moving member for knitting from moving with a force applied when the holder advances, and cancels the prevention when the holder passes by, and thus the removable moving member for knitting can be transferred to the travel means, in accordance with the switching of the stopping control lever, when the travel means lets the holder pass by the stopping means. A sensor detects whether or not there is the removable moving member for knitting at the position of the stopper portion of the stopping means, and thus it is possible to reliably detects that the removable moving member for knitting such as the yarn feeder has arrived at the position of the stopper portion of the stopping means.

Furthermore, according to the invention, various functions can be allocated to a plurality of removable moving members for knitting as knitting members, and thus it is possible to selectively utilize one or a plurality of functions for knitting a fabric.

Furthermore, according to the invention, it is possible to knit a fabric while switching knitting yarns of a plurality of colors and various characteristics with the removable moving members for knitting serving as yarn feeding ports.

Furthermore, according to the invention, it is possible to make the weft knitting machine smaller by directly mounting the knitting members on the carriages such that it is not necessary to install, for example, yarn guide rails. Since guide rails such as yarn guide rails are not provided, it is not necessary to provide a bringing and switching apparatus such as a bringing pin on the side of the carriages, and thus the carriages are prevented from being bulky and heavy, so that the durability is made good even in the weft knitting machine in which travels are heavily repeated with a small width and at a high speed. Furthermore, it is also possible to eliminate a possibility that the yarn feeding becomes unstable due to yarn guide rails vibrating or being warped, for example, when the frequency at which the carriages travel back and forth becomes high. In addition, yarn guide rails do not occupy the space above the narrow needle bed gap, and thus a maintenance operation, for example, can be easily performed.

Furthermore, according to the invention, it is possible to easily change the removable moving member for knitting as the knitting member such as a yarn feeder, by letting the travel means travel along paths such as yarn guide rails.

Furthermore, according to the invention, it is possible to improve the knitting efficiency by changing the position of the stopping means, the switching means, and the knitting member switching apparatus in accordance with the stitch width that is to be knitted and the like.

The invention claimed is:

1. A removable moving member for knitting having a base end portion and a front end portion, in which the base end portion is mountable on and dismountable from a travel member that travels along a needle bed of a weft knitting machine, the moving member being carried by the travel member without using a rail when the moving member is mounted on the travel member, wherein an operation of knitting a fabric is performed at the front end portion when the base end portion is mounted on the travel member comprising:

a hook member provided on the base end portion, and switchable between a hook state in which the hook member is mounted on the travel member including a support member to be hooked to the travel member by sandwiching the support member in a vertical direction, and a non-hook state in which the hook member is not hooked on the travel member; and a biasing device, provided on the base end portion, to bias with a spring, the hook member maintaining a hook state on the travel member when mounted on the travel member, wherein the hook member is switchable from the hook state to the non-hook state against a biasing force of the biasing device when a predetermined external force is applied.

2. The removable moving member for knitting of claim 1, wherein the hook member includes a pair of levers that intersect each other in a middle and in a shape of an X, the pair of levers being swingingly displaceable around an intersecting portion, and wherein the pair of levers includes one end sides for hooking on the travel member, and other end sides for receiving the predetermined external force, and the biasing device biases with the spring and the pair of levers such that the one end sides move closer to each other.

3. The removable moving member for knitting of claim 2, wherein the biasing device is a wire-shaped spring or a plate-shaped spring provided at a position closer to the one end sides of the levers with respect to the intersecting portion of the pair of levers of the hook member, the biasing device including a middle portion which is curved and uses the intersecting portion as a supporting point such that both ends can move resiliently, and the pair of levers includes pressing portions that are provided on portions on the other end sides with respect to the intersecting portion, and abut against the spring, the pair of levers receiveing the biasing force of the spring by a pressing force from the spring.

4. A weft knitting machine provided with a knitting member switching apparatus, comprising:

a travel member provided with a holder having a support member on which the removable moving member for knitting according to claim 1 is mountable;

a stopping member provided on a path on which the travel member travels, the stopping member being used to stop the removable moving member for knitting;

a switching member provided on the stopping member, to apply an external force for switching the hook member of the removable moving member for knitting between the hook state and the non-hook state; and a knitting member switching apparatus to shift to a state in which the removable moving member for knitting is stopped by the stopping member, by switching the base end portion to the non-hook state with respect to the holder, and by applying an external force from the switching member to the hook member, when the travel member passes by the stopping member while the removable moving member for knitting is mounted as the knitting member on the holder, the knitting member being further used to switch between maintaining a state in which the removable moving member for knitting is stopped by the stopping member and shifting to the hook state in which the removable moving member for knitting is mounted on the holder of the travel member, by applying or not applying an external force from the switching member to the hook member, when the travel member passes by the stopping member while the removable moving member for knitting is stopped by the stopping member.

5. The weft knitting machine of claim 4, wherein the holder has a plurality of positions on which the removable moving member for knitting is mountable, and the knitting member switching apparatus being usable to mount the removable moving member for knitting on the holder by selecting one of the plurality of positions.

6. The weft knitting machine of claim 4, wherein the switching member includes:

a stopping control lever that projects from the stopping member to one side of a path on which the travel member travels such that the stopping control lever is along the path, the stopping control lever being swingingly displaceable around a supporting point provided on the other side the path, and slidingly abutable against the other sides on the hook member when the travel member on which the removable moving member for knitting is mounted moves closer from the one side;

a biasing member to bias the stopping control lever to a direction in which an external force for switching the hook member to the non-hook member is not applied;

a force receiving member, provided at a position away from the supporting point on the other side of the path, to swingingly displace the stopping control lever in a direction in which the one side applies an external force for switching the hook member to the non-hook state, against a biasing force of the biasing member, when a pressing force is received while the holder that is provided on the travel member passes by; and a lever lock member to lock a state in which the stopping control lever is swingingly displaced with a pressing force to the force receiving member, wherein the stopping member includes a stopper portion provided on the other side of the path, to allow the travel member to travel while preventing the movement of the removable moving member for knitting.

7. The weft knitting machine of 4, wherein the switching member includes:

a stopping control lever, projecting from the stopping member to one side of a path on which the travel member travels such that the stopping control lever is along the path, the stopping control lever being swingingly displaceable around a supporting point provided on the other side of the path, and being slidingly abutable against the other sides on the hook member when the travel member, on which the removable moving member for knitting, is mounted moves closer from the one side; and an actuator to switch the stopping control lever between a state in which an external force for switching the hook member to the non-hook state is not applied, and a state in which the external force is applied, wherein the stopping member includes a stopper portion provided on the other side of the path, to allow the travel member to travel while preventing the movement of the removable moving member for knitting.

8. The weft knitting machine of claim 6, wherein the stopping member includes:

a stopper to prevent the removable moving member for knitting from moving so that the removable moving member for knitting does not move together with the holder when the travel member permits the holder from advancing from the other side while the removable moving member for knitting is stopped, and to cancel the prevention when the holder passes by; and a sensor to detect whether or not the removable moving member for knitting is at the position of the stopper portion.

9. The weft knitting machine of claim 4, further comprising a plurality of removable moving members for knitting, a plurality of holders, and a plurality of stopping members, wherein the knitting member switching apparatus is usable to selectively mount one or a plurality of removable moving members for knitting on the holders that are provided, in correspondence with the selected removable moving members for knitting.

10. The weft knitting machine of claim 4, wherein the removable moving member for knitting operates as a yarn feeding port for feeding a knitting yarn to a knitting needle.

11. The weft knitting machine of claim 4, wherein the travel member is a carriage that travels back and forth along a needle bed, and provides knitting needless arranged side by side on the needle bed to perform a knitting operation.

12. The weft knitting machine of claim 4, wherein the travel member travels on a path that faces a side on which a fabric is knitted on the needle bed.

13. The weft knitting machine of claim 4, wherein the stopping member, the switching member, and the knitting member switching apparatus are movable.

14. The weft knitting machine of claim 7, wherein the stopping member includes:

a stopper to prevent the removable moving member for knitting from moving such that the removable moving member for knitting does not move together with the holder when the travel member permits the holder from advancing from the other side whiled the removable moving member for knitting is stopped, and to cancel the prevention when the holder passes by; and a sensor to detect whether or not the removable moving member for knitting is the position of the stopper portion.

* * * * *